US009031834B2

(12) United States Patent
Coorman et al.

(10) Patent No.: US 9,031,834 B2
(45) Date of Patent: May 12, 2015

(54) SPEECH ENHANCEMENT TECHNIQUES ON THE POWER SPECTRUM

(75) Inventors: Geert Coorman, Kuurne (BE); Johan Wouters, Cham (CH)

(73) Assignee: Nuance Communications, Inc., Burlington, MA (US)

( * ) Notice: Subject to any disclaimer, the term of this patent is extended or adjusted under 35 U.S.C. 154(b) by 523 days.

(21) Appl. No.: 13/393,667

(22) PCT Filed: Sep. 4, 2009

(86) PCT No.: PCT/CH2009/000297

§ 371 (c)(1),
(2), (4) Date: Jun. 29, 2012

(87) PCT Pub. No.: WO2011/026247

PCT Pub. Date: Mar. 10, 2011

(65) Prior Publication Data

US 2012/0265534 A1 Oct. 18, 2012

(51) Int. Cl.
*G10L 21/00* (2013.01)
*G10L 21/02* (2013.01)
(Continued)

(52) U.S. Cl.
CPC ..... *G10L 21/0205* (2013.01); *G10L 21/0232* (2013.01); *G10L 21/003* (2013.01); *G10L 13/033* (2013.01)

(58) Field of Classification Search
CPC . G10L 21/0232; G10L 21/02; G10L 21/0205; G10L 21/003
USPC ..... 704/200–269
See application file for complete search history.

(56) References Cited

U.S. PATENT DOCUMENTS 5,247,579 A 9/1993 Hardwick et al. ..... 381/40
5,664,051 A 9/1997 Hardwick et al. ..... 704/206
(Continued)

FOREIGN PATENT DOCUMENTS

WO WO 2005/059900 6/2005 ..... G10L 19/00

OTHER PUBLICATIONS

Yegnanarayana et al., "Significance of Group Delay Functions in Signal Reconstruction from Spectral Magnitude or Phase", IEEE, Jun. 1, 1984, pp. 610-622.
(Continued)

*Primary Examiner* — Samuel G Neway
(74) *Attorney, Agent, or Firm* — Daly, Crowley, Mofford & Durkee, LLP

(57) ABSTRACT

The method provides a spectral speech description to be used for synthesis of a speech utterance, where at least one spectral envelope input representation is received. In one solution the improvement is made by manipulation an extremum, i.e. a peak or a valley, in the rapidly varying component of the spectral envelope representation. The rapidly varying component of the spectral envelope representation is manipulated to sharpen and/or accentuate extrema after which it is merged back with the slowly varying component or the spectral envelope input representation to create an enhanced spectral envelope final representation. In other solutions a complex spectrum envelope final representation is created with phase information derived from one of the group delay representation of a real spectral envelope input representation corresponding to a short-time speech signal and a transformed phase component of the discrete complex frequency domain input representation corresponding to the speech utterance.

9 Claims, 12 Drawing Sheets

(51) Int. Cl.

| | |
|---|---|
| ***G10L 21/0232*** | (2013.01) |
| ***G10L 21/003*** | (2013.01) |
| ***G10L 13/033*** | (2013.01) |

(56) References Cited

U.S. PATENT DOCUMENTS

| | | | | |
|---|---|---|---|---|
| 5,864,812 | A | 1/1999 | Kamai et al. | 704/268 |
| 5,953,696 | A * | 9/1999 | Nishiguchi et al. | 704/209 |
| 5,966,689 | A * | 10/1999 | McCree | 704/226 |
| 6,115,684 | A | 9/2000 | Kawahara et al. | 704/203 |
| 6,173,256 | B1 | 1/2001 | Gigi | 704/219 |
| 7,065,485 | B1 * | 6/2006 | Chong-White et al. | 704/208 |
| 2003/0072464 | A1 * | 4/2003 | Kates | 381/312 |
| 2005/0165608 | A1 | 7/2005 | Suzuki et al. | 704/261 |
| 2005/0187762 | A1 | 8/2005 | Tanaka et al. | 704/220 |
| 2009/0144053 | A1 | 6/2009 | Tamura et al. | 704/207 |
| 2010/0250254 | A1 * | 9/2010 | Mizutani | 704/260 |

OTHER PUBLICATIONS

Yegnanarayana et al., "Processing of Noisy Speech Using Modified Group Delay Functions", IEEE, Apr. 14, 1991, pp. 945-948.

Syrdal et al., "TD-PSOLA Versus Harmonic Plus Noise Model in Diphone Based Speech Synthesis".

Min et al., "A Hybrid Approach to Synthesize High Quality Cantonese Speech", IEEE, May 12, 1998, pp. 277-280.

Banno et al., "Efficient Representation of Short-Time Phase Based on Group Delay", IEEE, May 12, 1998, pp. 861-864.

El-Imam, "Synthesis of the intonation of neutrally spoken Modern Standard Arabic speech", Elsevier, Signal Processing 88, Sep. 1, 2008, pp. 2206-2221.

International Searching Authority, International Search Report—International Application No. PCT/CH2009/000297, dated Jul. 8, 2010, together with the Written Opinion of the International Searching Authority, 20 pages.

The International Bureau of WIPO, International Preliminary Report on Patentability- International Application No. PCT/CH2009/000297 dated Mar. 15, 2012, 15 pages. (English translation).

* cited by examiner

SPEECH ENHANCEMENT TECHNIQUES ON THE POWER SPECTRUM

TECHNICAL FIELD

The present invention generally relates to speech synthesis technology.

BACKGROUND OF THE INVENTION

Speech Analysis and Speech Synthesis

Speech is an acoustic signal produced by the human vocal apparatus. Physically, speech is a longitudinal sound pressure wave. A microphone converts the sound pressure wave into an electrical signal. The electrical signal can be sampled and stored in digital format. For example, a sound CD contains a stereo sound signal sampled 44100 times per second, where each sample is a number stored with a precision of two bytes (16 bits).

In many speech technologies, such as speech coding, speaker or speech recognition, and speech synthesis, the speech signal is represented by a sequence of speech parameter vectors. Speech analysis converts the speech waveform into a sequence of speech parameter vectors. Each parameter vector represents a subsequence of the speech waveform. This subsequence is often weighted by means of a window. The effective time shift of the corresponding speech waveform subsequence after windowing is referred to as the window length. Consecutive windows generally overlap and the time span between them is referred to as the window hop size. The window hop size is often expressed in number of samples. In many applications, the parameter vectors are a lossy representation of the corresponding short-time speech waveform. Many speech parameter vector representations disregard phase information (examples are MFCC vectors and LPC vectors). However, short-time speech representations can also have lossless representations (for example in the form of overlapping windowed sample sequences or complex spectra). Those representations are also vector representations. The term "speech description vector" shall therefore include speech parameter vectors and other vector representations of speech waveforms. However, in most applications, the speech description vector is a lossy representation which does not allow for perfect reconstruction of the speech signal.

The reverse process of speech analysis, called speech synthesis, generates a speech waveform from a sequence of speech description vectors, where the speech description vectors are transformed to speech subsequences that are used to reconstitute the speech waveform to be synthesized. The extraction of waveform samples is followed by a transformation applied to each vector. A well known transformation is the Discrete Fourier Transform (DFT). Its efficient implementation is the Fast Fourier Transform (FFT). The DFT projects the input vector onto an ordered set of orthonormal basis vectors. The output vector of the DFT corresponds to the ordered set of inner products between the input vector and the ordered set of orthonormal basis vectors. The standard DFT uses orthonormal basis vectors that are derived from a family of the complex exponentials. To reconstruct the input vector from the DFT output vector, one must sum over the projections along the set of orthonormal basis functions. Another well known transformation-linear prediction-calculates linear prediction coefficients (LPC) from the waveform samples. The FFT or LPC parameters can be further transformed using Mel-frequency warping. Mel-frequency warping imitates the "frequency resolution" of the human ear in that the spectrum at high frequencies is represented with less information than the spectrum at lower frequencies. This frequency warping can be efficiently implemented by means of a well-known bilinear conformal transformation in the Z-domain which maps the unit circle on itself:

$$\hat{z}^{-1} = H(z) = \frac{z^{-1} - \alpha}{1 - \alpha z^{-1}} \tag{1}$$

With $z=e^{i\omega}$ and $\alpha$ a real-valued parameter

For example at 16 kHz, the bilinearly warped frequency scale provides a good approximation to the Mel-scale when $\alpha=0.42$.

The Mel-warped FFT or LPC magnitude spectrum can be further converted into cepstral parameters [Imai, S., "Cepstral analysis/synthesis on the Mel-frequency scale", in proceedings of ICASSP-83, Vol. 8, pp. 93-96]. The resulting parameterisation is commonly known as Mel-Frequency Cepstral Coefficients (MFCCs). FIG. 1 shows one way how the MFCC's are computed. First a Fourier Transform is used to transform the speech waveform x(n) to the spectral domain $X(\omega)$, whereafter the magnitude spectrum is logarithmically compressed (i.e. log-magnitude), resulting in $|\check{X}(\omega)|$. The log-magnitude spectrum is warped to the to the Mel-frequency scale resulting in $|\tilde{X}(\omega)|$, where after it is transformed to the cepstral domain by means of an inverse FFT. This sequence is then windowed and truncated to form the final MFCC vector c(n). An interesting feature of the MFCC speech description vector is that its coefficients are more or less uncorrelated. Hence they can be independently modelled or modified. The MFCC speech description vector describes only the magnitude spectrum. Therefore it does not contain any phase information. Schafer and Oppenheim generalised the real cepstrum (derived from the magnitude spectrum) to the complex cepstrum [Oppenheim & Schafer, "Digital Signal Processing", Prentice-Hall, 1975], defined as the inverse Fourier transform of the complex logarithm of the Fourier transform of the signal. The calculation of the complex cepstrum requires additional algorithms to unwrap the phase after taking the complex logarithm [J. M. Tribolet, "A new phase unwrapping algorithm," IEEE transactions on acoustics, speech, and signal processing, ASSP 25(2), pp. 170-177, 1977]. Most speech algorithms based on homomorphic processing keep it simple and avoid phase. Therefore the real cepstrum is systematically preferred over the complex cepstrum in speech synthesis and ASR. In order to synthesise from the phaseless real cepstrum representation, a phase assumption should be made. Oppenheim, for example, used cepstral parameters in a vocoding framework and used linear, minimum and maximum phase assumptions for re-synthesis [A. V. Oppenheim, "Speech analysis-Synthesis System Based on Homomorphic Filtering", JASA 1969 pp. 458-465]. More recently Imai et al. developed a "Mel Log Spectrum Approximation" digital filter whose parameters are directly derived from the MFCC coefficients themselves [Satoshi Imai, Kazuo Sumita, Chieko Furuichi, "Mel Log Spectrum Approximation (MLSA) filter for speech synthesis", Electronics and Communications in Japan (Part I: Communications), Volume 66 Issue 2, pp. 10-18, 1983]. The MLSA digital filter is intrinsically minimum phase.

If the magnitude and phase spectrum are well defined it is possible to construct a complex spectrum that can be converted to a short-time speech waveform representation by means of inverse Fourier transformation (IFFT). The final speech waveform is then generated by overlapping-and-adding (OLA) the short-time speech waveforms. Speech synthesis is used in a number of different speech applications and contexts: a.o. text-to-speech synthesis, decoding of encoded speech, speech enhancement, time scale modification, speech transformation etc.

In text-to-speech synthesis, speech description vectors are used to define a mapping from input linguistic features to output speech. The objective of text-to-speech is to convert an input text into a corresponding speech waveform. Typical process steps of text-to-speech are: text normalisation, grapheme-to-phoneme conversion, part-of-speech detection, prediction of accents and phrases, and signal generation. The steps preceding signal generation can be summarised as text analysis. The output of text analysis is a linguistic representation.

Signal generation in a text-to-speech synthesis system can be achieved in several ways. The earliest commercial systems used formant synthesis; where hand crafted rules convert the linguistic input into a series of digital filters. Later systems were based on the concatenation of recorded speech units. In so-called unit selection systems, the linguistic input is matched with speech units from a unit database, after which the units are concatenated.

A relatively new signal generation method for text-to-speech synthesis is the so-called HMM synthesis approach (K. Tokuda, T. Kobayashi and S. Imai: "Speech Parameter Generation From HMM Using Dynamic Features," in Proc. ICASSP-95, pp. 660-663, 1995). First, an input text is converted into a sequence of high-level context-rich linguistic input descriptors that contain phonetic and prosodic features (such as phoneme identity, position information . . . ). Based on the linguistic input descriptors, context dependent HMMs are combined to form a sentence HMM. The state durations of the sentence HMM are determined by an HMM based state duration model. For each state, a decision tree is traversed to convert the linguistic input descriptors into a sequence of magnitude-only speech description vectors. Those speech description vectors contain static and dynamic features. The static and dynamic features are then converted into a smooth sequence of magnitude-only speech description vectors (typically MFCC's). A parametric speech enhancement technique is used to enhance the synthesis voice quality. This technique does not allow for selective formant enhancement. The creation of the data used by the HMM synthesizer is schematically shown in FIG. 2. First the fundamental frequency (F0 in FIG. 2) is determined by a "pitch detection" algorithm. The speech signals are windowed and split into equidistant segments (called frames). The distance between successive frames is constant and equal to the window hop size). For each frame, the spectral envelope is obtained and a MFCC speech description vector ('real cepstrum' in FIG. 2) is derived through (frame-synchronous) cepstral analysis (FIG. 2) [T. Fukada, K. Tokuda, T. Kobayashi and S. Imai, "An adaptive algorithm for Mel-cepstral analysis of speech," Proc. of ICASSP'92, vol. 1, pp. 137-140, 1992]. The MFCC representation is a low-dimensional projection of the Mel-frequency scaled log-spectral envelope. In order to add dynamic information to the models, the static MFCC and F0 representations are augmented with their corresponding low-order dynamics (delta's and delta-delta's). The context dependent HMMs are generated by a statistical training process (FIG. 2) that is state of the art in speech recognition. It consists of aligning Hidden Markov Model states with a database of speech parameter vectors (MFCC's and F0's), estimating the parameters of the HMM states, and decision-tree based clustering the trained HMM states according to a number of high-level context-rich phonetic and prosodic features (FIG. 2). In order to increase perceived naturalness, it is possible to add additional source information.

In its original form, speech enhancement was focused on speech coding. During the past decades, a large number of speech enhancement techniques were developed. Nowadays, speech enhancement describes a set of methods or techniques that are used to improve one or more speech related perceptual aspects for the human listener or to pre-process speech signals to optimise their properties so that subsequent speech processing algorithms can benefit from that pre-processing.

Speech enhancement is used in many fields: among others: speech synthesis, noise reduction, speech recognition, hearing aids, reconstruction of lost speech packets during transmission, correction of so-called "hyperbaric" speech produced by deep-sea divers breathing a helium-oxygen mixture and correction of speech that has been distorted due to a pathological condition of the speaker. Depending on the application, techniques are based on periodicity enhancement, spectral subtraction, de-reverberation, speech rate reduction, noise reduction etc. A number of speech enhancement methods apply directly on the shape of the spectral envelope.

Vowel envelope spectra are typically characterised by a small number of strong peaks and relatively deep valleys. Those peaks are referred to as formants. The valleys between the formants are referred to as spectral troughs. The frequencies corresponding to local maxima of the spectral envelope are called formant frequencies. Formants are generally numbered from lower frequency toward higher frequency. FIG. 3 shows a spectral envelope with three formants. The formant frequencies of the first three formants are appropriately labelled as F1, F2 and F3. Between the different formants of the spectral envelope one can observe the spectral troughs.

The spectral envelope of a voiced speech signal has the tendency to decrease with increasing frequency. This phenomenon is referred to as the "spectral slope". The spectral slope is in part responsible for the brightness of the voice quality. As a general rule of thumb we can state that the steeper the spectral slope the duller the speech will be.

Although formant frequencies are considered to be the primary cues to vowel identity, sufficient spectral contrast (difference in amplitude between spectral peaks and valleys) is required for accurate vowel identification and discrimination. There is an intrinsic relation between spectral contrast and formant bandwidths: spectral contrast is inversely proportional to the formant bandwidths; broader formants result in lower spectral contrast. When the spectral contrast is reduced, it is more difficult to locate spectral prominence (i.e., formant constellation) which provides important information for intelligibility [A. de Cheveigné, "Formant Bandwidth Affects the Identification of Competing Vowels," ICPHS99, 1999]. Besides intelligibility, spectral contrast has also an impact on voice quality. Low spectral contrast will often result in a voice quality that could be categorised as muffled or dull. In a synthesis or coding framework, a lack of spectral contrast will often result in an increased perception of noise. Furthermore, it is known that voice qualities such as brightness and sharpness are closely related with spectral contrast and spectral slope. The more the higher formants (from second formant on) are emphasised, the sharper the voice will sound. However, attention should be paid because an over-emphasis of formants may destroy the perceived naturalness.

Spectral contrast can be affected in one or more steps in a speech processing or transmission chain. Examples are:

Short-time windowing of speech segments ("spectral blur")

Short-time windows are frequently used in speech processing. Spectral blur is a consequence of the convolution of the speech spectrum with the short-time window spectrum. The shorter the window, the more the spectrum is blurred.

Multiband compression

Since the spectral contrast within a band is preserved, only inter-band contrast is affected. Contrast reduction becomes more prominent as the number of bands increases.

Averaging of speech spectra:

In some applications, speech spectra are averaged. The averaging typically occurs after transforming the spectra to a parametric domain. For example some speech encoding systems or voice transformation systems use vector quantisation to determine a manageable number of centroids. These centroids are often calculated as the average of all vectors of the corresponding Voronoi cell. In some speech synthesis applications, for example HMM based speech synthesis, the speech description vectors that drive the synthesiser are calculated through a process of HMM-training and clustering. These two processes are responsible for the averaging effect.

Contamination of the speech signal by additive noise reduces the spectral troughs. Noise can be introduced by: making recordings under noisy conditions, parameter quantisation, analog signal transmission . . . .

Contrast enhancement finds its origins in speech coding where parametric synthesis techniques were widely used. Based on the parametric representation of the time varying synthesis filter, one or more time varying enhancement filters were generated. Most enhancement filters were based on pole shifting which was effectuated by transforming the Z-transform of the synthesis filter to a concentric circle different from the unit circle. Those transformations are special cases of the chirp Z-transform. [L. Rabiner, R. Schafer, & C. Rader, "The chirp z-transform algorithm," IEEE Trans. Audio Electroacoust., vol. AU-17, pp. 86-92, 1969]. Some of those filter combinations were used in the feedback loop of coders as a way to minimise "perceptual" coding noise e.g. in CELP coding [M. R. Schroeder and B. S. Atal, "Code Excited Linear Prediction (CELP): High-Quality Speech at Very Low Bit Rates," Proc. IEEE Int. Conf. Acoust. Speech, Signal Processing, pp. 937-940 (1985)] while other enhancement filters were put in series with the synthesis filter to reduce quantisation noise by deepening the spectral troughs. Sometimes these enhancement filters were extended with an adaptive comb filter to further reduce the noise [P. Kroon & B. S Atal, "Quantisation Procedures for the Excitation in CELP Coders," Proc. ICASSP-87, pp. 1649-1652, 1987].

Unfortunately, the decoded speech was often characterised by a loss of brightness because the enhancement filter affected the spectral tilt. Therefore, more advanced adaptive post-filters were developed. These post filters were based on a cascade of an adaptive formant emphasis filter and an adaptive spectral tilt compensation filter [J-H. Chen & A. Gersho, "*Adaptive postfiltering for quality enhancement of coded speech*," IEEE Trans. Speech and Audio Processing, vol. SAP-3, pp. 59-71, 1995]. However spectral controllability is limited by criteria such as the size of the filter and the filter configuration, and the spectral tilt compensation filter does not neutralise all unwanted changes in the spectral tilt.

Parametric enhancement filters do not provide fine control and are not very flexible. They are only useful when the spectrum is represented in a parametric way. In other situations it is better to use frequency domain based solutions. A typical frequency domain based approach is shown by FIG. 4. The input signal $s_t$ is divided in overlapping analysis frames and appropriately windowed to equal-length short-term signals $x_n$. Next the time domain representation $x_n$ is transformed into the frequency domain through Fourier Transformation which results in the complex spectrum $X(\omega)$, with $\omega$ the angular frequency. $X(\omega)=|X(\omega)|e^{j\arg(X(\omega))}$ is decomposed into a magnitude spectrum $|X(\omega)|$ and a phase spectrum $\arg(X(\omega))$. The magnitude spectrum $|X(\omega)|$ is modified into an enhanced magnitude spectrum $|\hat{X}(\omega)|=f(|X(\omega)|)$ whereafter the original phase is added to create a complex spectrum $Y(\omega)=|\hat{X}(\omega)|e^{j\arg(X(\omega))}$. Inverse Fourier Transformation is used to convert the complex spectrum $Y(\omega)$ into a time-domain signal y(n) where after it is overlapped and added to generate the enhanced speech signal $\hat{s}_t$.

Some frequency domain methods combine parametric techniques with frequency domain techniques [R. A. Finan & Y. Liu, "Formant enhancement of speech for listeners with impaired frequency selectivity," Biomed. Eng., Appl. Basis Comm. 6 (1), pp. 59-68, 1994] while others do the entire processing in the frequency domain. For example Bunnell [T. H. Bunnell, "On enhancement of spectral contrast in speech for hearing-impaired listeners," J. Acoust. Soc. Amer. Vol. 88 (6), pp. 2546-2556, 1990] increased the spectral contrast using the following equation:

$$H_k^{enh}=\alpha(H_k-C)+C$$

where $H_k^{enh}$ is the contrast enhanced magnitude spectrum at frequency bin k, $H_k$ is the original magnitude spectrum at frequency bin k, C is a constant that corresponds to the average spectrum level, and $\alpha$ is a tuning parameter. All spectrum levels are logarithmic. The contrast is reduced when $\alpha<1$ and enhanced when $\alpha>1$. In order to get the desired performance improvement and to avoid some disadvantages, non-uniform contrast weights were used. Therefore contrast is emphasised mainly at middle frequencies, leaving high and low frequencies relatively unaffected. Only small improvements were found in the identification of stop consonants presented in quiet to subjects with sloping hearing losses.

The frequency domain contrast enhancement techniques enjoy higher selectivity and higher resolution than most parametric techniques. However, the techniques are computationally expensive and sensitive to errors.

It is a scope of the inventions of this application to find new and inventive enhancement solutions.

Phase

In some applications such as low bit rate coders and HMM based speech synthesisers, no phase is transmitted to the synthesiser. In order to synthesise voiced sounds a slowly varying phase needs to be generated.

In some situations, the phase spectrum can be derived from the magnitude spectrum. If the zeroes of the Z-transform of a speech signal lie either entirely inside or outside the unit circle, then the signal's phase is uniquely related to its magnitude spectrum through the well known Hilbert relation [T. F. Quatieri and A. V. Oppenheim, "Iterative techniques for minimum phase signal reconstruction from phase or magnitude", IEEE Trans. Acoust., Speech, and Signal Proc., Vol. 29, pp. 1187-1193, 1981]. Unfortunately this phase assumption is usually not valid because most speech signals are of a mixed phase nature (i.e. can be considered as a convolution of a minimum and a maximum phase signal). However, if the spectral magnitudes are derived from partly overlapping short-time windowed speech, phase information can be reconstructed from the redundancy due to the overlap. Several algorithms have been proposed to estimate a signal from partly overlapping STFT magnitude spectra. Griffin and Lim

[D. W. Griffin and J. S. Lim, "*Signal reconstruction from short-time Fourier transform magnitude*", IEEE Trans. Acoust., Speech, and Signal Proc., Vol. 32 pp. 236-243, 1984] calculate the phase spectrum based on an iterative technique with significant computational load.

In applications such as HMM based speech synthesis, there is no hidden phase information under the form of spectral redundancy because the partly overlapping magnitude spectra are generated by models themselves. Therefore one has to resort to phase models. Phase models are mainly important in case of voiced or partly voiced speech (however, there are strong indications that the phase of unvoiced signals such as the onset of bursts is also important for intelligibility and naturalness). A distinction should be made between trainable phase models and analytic phase models. Trainable phase models relay on statistics (and a large corpus of examples), while analytic phase models are based on assumptions or relations between a number of (magnitude) parameters and the phase itself.

Burian et al. [A. Burian & J. Takala, "A recurrent neural network for 1-D phase retrieval", ICASSP 2003] proposed a trainable phase model based on a recurrent neural network to reconstruct the (minimum) phase from the magnitude spectrum. Recently, Achan et al. [K. Achan, S. T. Roweis and B. J. Frey, "Probabilistic Inference of Speech Signals from Phaseless Spectrograms", In S. Thrun et al. (eds.), Advances in Neural Information Processing Systems 16, MIT Press, Cambridge, Mass., 2004] proposed a statistical learning technique to generate a time-domain signal with a defined phase from a magnitude spectrum based on a statistical model trained on real speech.

Most analytic phase models for voiced speech can be scaled down to the convolution of a quasi periodic excitation signal and a (complex) spectral envelope. Both components have their own sub-phase model. The simplest phase model is the linear phase model. This idea is borrowed from FIR filter design. The linear phase model is well suited for spectral interpolation in the time domain without resorting to expensive frequency domain transformations. Because the phase is static, speech synthesised with the linear phase model sounds very buzzy. A popular phase model is the minimum phase model, as used in the mono-pulse excited LPC (e.g. Dod-LPC10 decoder) and MLSA synthesis systems. There are efficient ways to convert a cepstral representation to a minimum phase spectrum [A. V. Oppenheim, "Speech analysis-Synthesis System Based on Homomorphic Filtering", JASA 1969 pp. 458-465]. A minimum phase system in combination with a classical mono-pulse excitation sounds unnatural and buzzy. Formant synthesisers utilise more advanced excitation models (such as the Liljencants-Fant model). The resulting phase is the combination of the phase of the resonance filters (cascaded or in parallel) with the phase of the excitation model. In addition, the parameters of the excitation model provide additional degrees of freedom to control the phase of the synthesised signal.

In order to increase the naturalness of HMM based synthesisers and of low bit-rate parametric coders, better and more efficient phase models are required. It is a specific scope of inventions of this application to find new and inventive phase model solutions.

SUMMARY OF THE INVENTIONS

In view of the foregoing, the need exists for an improved spectral magnitude and phase processing technique. More specifically, the object of the present invention is to improve at least one out of controllability, precision, signal quality, processing load, and computational complexity.

A present first invention is a method to provide a spectral speech description to be used for synthesis of a speech utterance, where at least one spectral envelope input representation is received and from the at least one spectral envelope input representation a rapidly varying input component is extracted, and the rapidly varying input component is generated, at least in part, by removing from the at least one spectral envelope input representation a slowly varying input component in the form of a non-constant coarse shape of the at least one spectral envelope input representation and by keeping the fine details of the at least one spectral envelope input representation, where the details contain at least one of a peak or a valley.

Speech description vectors are improved by manipulating an extremum, i.e. a peak or a valley, in the rapidly varying component of the spectral envelope representation. The rapidly varying component of the spectral envelope representation is manipulated to sharpen and/or accentuate extrema after which it is merged back with the slowly varying component or the spectral envelope input representation to create an enhanced spectral envelope final representation with sharpened peaks and deepened valleys. By extracting the rapidly varying component, it is possible to manipulate the extrema without modifying the spectral tilt.

The processing of the spectral envelope is preferably done in the logarithmic domain. However the embodiments described below can also be used in other domains (e.g. linear domain, or any non-linear monotone transformation). The manipulation of the extrema directly on the spectral envelope as opposed another signal representation such as the time domain signal makes the solution simpler and facilitates controllability. It is a further advantage of this solution that only a rapidly varying component has to be derived.

The method of the first invention provides a spectral speech description to be used for synthesis of a speech utterance comprising the steps of

- receiving at least one spectral envelope input representation corresponding to the speech utterance,
  - where the at least one spectral envelope input representation includes at least one of at least one formant and at least one spectral trough in the form of at least one of a local peak and a local valley in the spectral envelope input representation,
- extracting from the at least one spectral envelope input representation a rapidly varying input component, where the rapidly varying input component is generated, at least in part, by removing from the at least one spectral envelope input representation a slowly varying input component in the form of a non-constant coarse shape of the at least one spectral envelope input representation and by keeping the fine details of the at least one spectral envelope input representation, where the details contain at least one of a peak or a valley,
- creating a rapidly varying final component, where the rapidly varying final component is derived from the rapidly varying input component by manipulating at least one of at least one peak and at least one valley,
- combining the rapidly varying final component with one of the slowly varying final component and the spectral envelope input representation to form a spectral envelope final representation, and
- providing a spectral speech description output vector to be used for synthesis of a speech utterance, where at least a part of the spectral speech description output vector is derived from the spectral envelope final representation.

A present second invention is a method to provide a spectral speech description output vector to be used for synthesis of a short-time speech signal comprising the steps of receiving at least one real spectral envelope input representation corresponding to the short-time speech signal, deriving a group delay representation that is the output of a non-constant function of the at least one real spectral envelope input representation, deriving a phase representation from the group delay representation by inverting the sign of the group delay representation and integrating the inverted group delay representation, deriving from the at least one real spectral envelope input representation at least one real spectral envelope final representation, combining the real spectral envelope final representation and the phase representation to form a complex spectrum envelope final representation, and providing a spectral speech description output vector to be used for synthesis of a short-time speech signal, where at least a part of the spectral speech description output vector is derived from the complex spectral envelope final representation.

Deriving from the at least one real spectral envelope input representation a group delay representation and from the group delay representation a phase representation allows a new and inventive creation of a complex spectrum envelope final representation. The phase information in this complex spectrum envelope final representation allows creation of a spectral speech description output vector with improved phase information. A synthesis of a speech utterance using the spectral speech description output vector with the phase information creates a speech utterance with a more natural sound.

A present third invention is realised at least in one form of an offline analysis and an online synthesis.

The offline analysis is a method for providing a speech description vector to be used for synthesis of a speech utterance comprising the steps of receiving at least one discrete complex frequency domain input representation corresponding to the speech utterance, decomposing the complex frequency domain input representation into a magnitude and a phase component defined at a set of input frequencies, transforming the phase component to a transformed phase component having less discontinuities, compressing the magnitude component with a compression function to form a compressed magnitude component, interpolating the compressed magnitude and transformed phase components at a set of output frequencies to form a frequency warped compressed magnitude and a frequency warped transformed phase component, the output frequencies being obtained by transforming the input frequencies by means of a frequency warping function that maps at least one input frequency to a different output frequency, rotating the frequency warped phase component in the complex plane by 90 degrees to obtain a purely imaginary frequency warped phase component, adding the frequency warped compressed magnitude component to the purely imaginary frequency warped phase component to form a complex frequency warped compressed spectrum representation, projecting the complex frequency warped compressed spectrum representation onto a non-empty ordered set of complex basis functions to form a complex frequency warped cepstrum representation to be used for synthesis of a speech utterance.

The online synthesis is a method for providing an output magnitude and phase representation to be used for speech synthesis comprising the steps of receiving at least one speech description input vector, preferably a frequency warped complex cepstrum vector, projecting the speech description input vector onto an ordered non-empty set of complex basis vectors to form a vector of spectral speech description coefficients defined at equidistant input points, the N-th coefficient being equal to the inner product between the speech description input vector and the N-th basis vector, transforming the imaginary component of the spectral speech description vector to form a transformed spectral speech description vector, interpolating the set of transformed spectral speech description coefficients at a number of output points to form a vector of warped spectral speech description coefficients, where at least one output point enclosed by at least two points is not centred in the middle between its left and right neighbouring points, extracting the imaginary components of the of an ordered set of warped spectral speech description coefficients to form a real output phase representation, expanding the real components of the warped spectral speech description coefficients with a magnitude expansion function to form an output magnitude representation.

The steps of this method allow a new and inventive synthesis of a speech utterance with phase information. The values of the cepstrum are relatively uncorrelated, which is advantageous for statistical modeling. The method is especially advantageous if the at least one discrete complex frequency domain representation is derived from at least one short-time digital signal padded with zero values to form an expanded short-time digital signal and the expanded short-time digital signal is transformed into a discrete complex frequency domain representation. In this case the complex cepstrum can be truncated by preserving the $M_I+1$ initial values and the $M_O$ final values of the cepstrum. Natural sounding speech with adequate phase characteristics can be generated from the truncated cepstrum.

The inventions related to the creation of phase information (second and third inventions) are especially advantageous when combined with the first invention pertaining to the manipulation of the rapidly varying component of the spectral envelope representation. The combination of the improved spectral extrema and the improved phase information allows the creation of natural and clear speech utterances.

DETAILED DESCRIPTION OF THE INVENTIONS

System Overview

Figure 1:
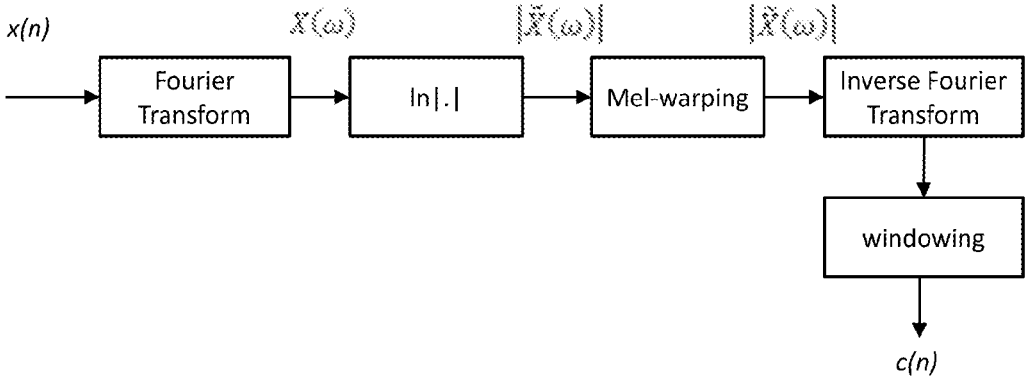
FIG. 1 shows the different steps to compute an MFCC speech description vector from a windowed speech signal $x_n$ $n\epsilon[0 \ldots N]$. The output $c_n$ $n\epsilon[0 \ldots K]$ with $K \leq N$ is the MFCC speech description vector.
Figure 2:
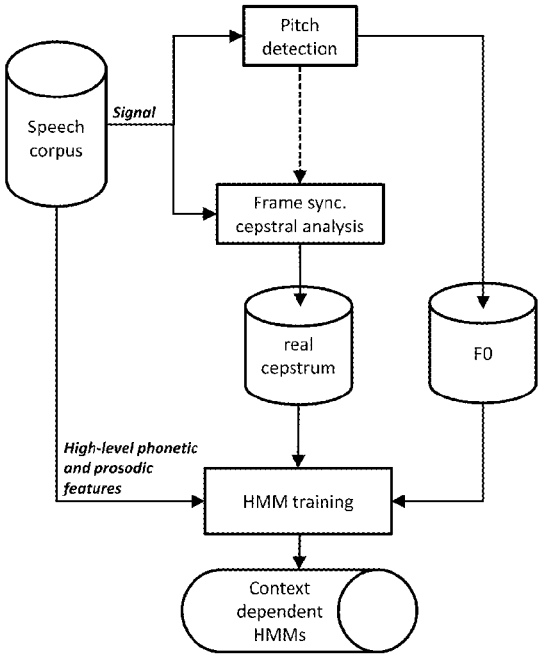
FIG. 2 is a schematic diagram of the feature extraction to create context dependent HMMs that can be used in HMM based speech synthesis.
Figure 3:
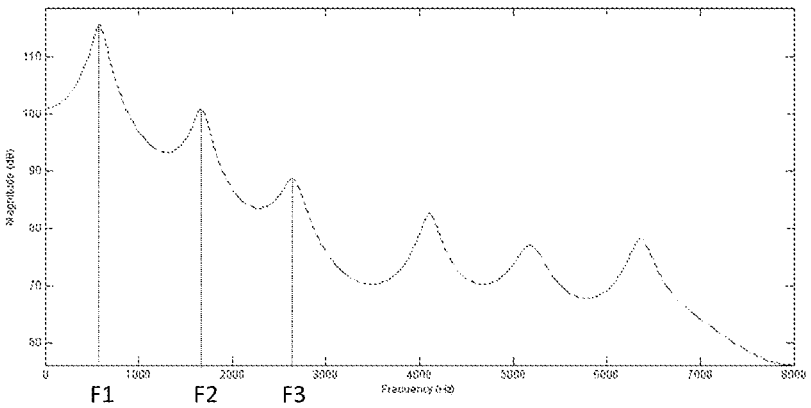
FIG. 3 is a representation of a spectral envelope of a speech sound showing the first three formants with their formant frequencies F1, F2 & F3, where the horizontal axis corresponds with the frequency (e.g. FFT bins) while the vertical axis corresponds with the magnitude of the envelope expressed in dB.
Figure 4:
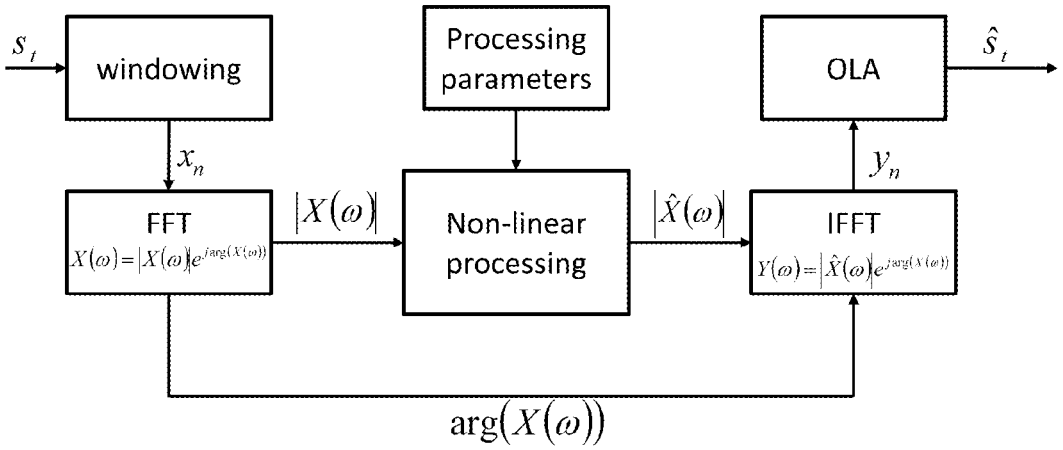
FIG. 4 is a schematic diagram of a generic FFT-based spectral contrast sharpening system.
Figure 5:
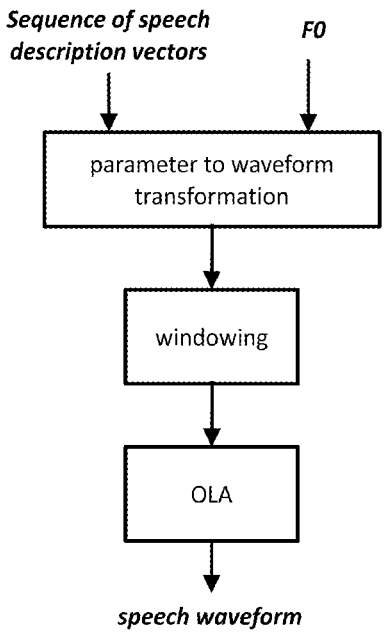
FIG. 5 is a schematic diagram of an overlap-and-add based speech synthesiser that transforms a sequence of speech description vectors and a F0 contour into a speech waveform.
Figure 6:
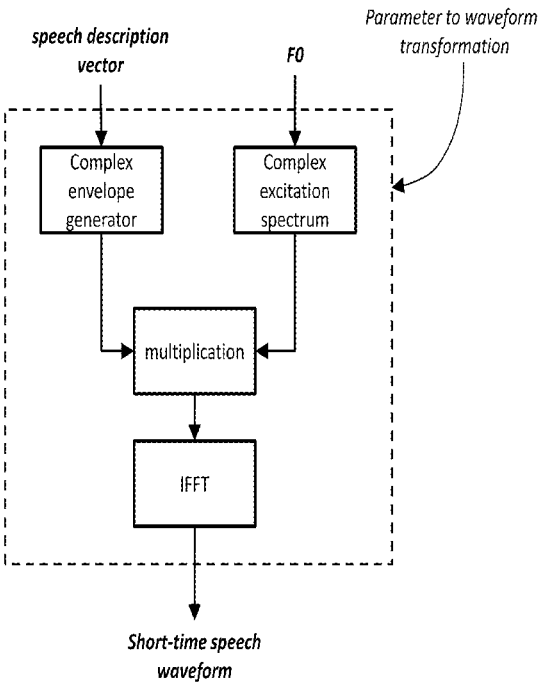
FIG. 6 is a schematic diagram of a parameter to short-time waveform transformation system based on spectrum multiplication (as used in FIG. 5).
Figure 7:
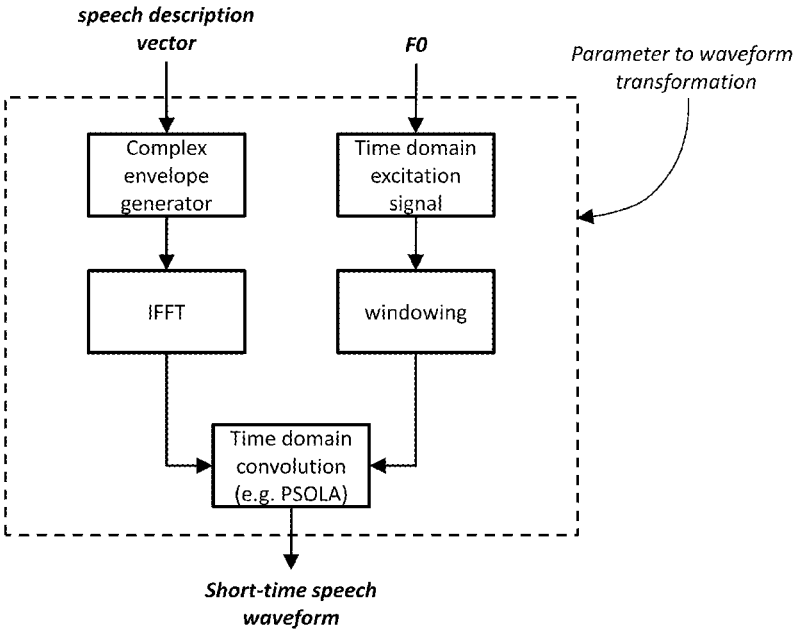
FIG. 7 is a schematic diagram of a parameter to short-time waveform transformation system based on pitch synchronous overlap-and-add (as used in FIG. 5).
Figure 8:
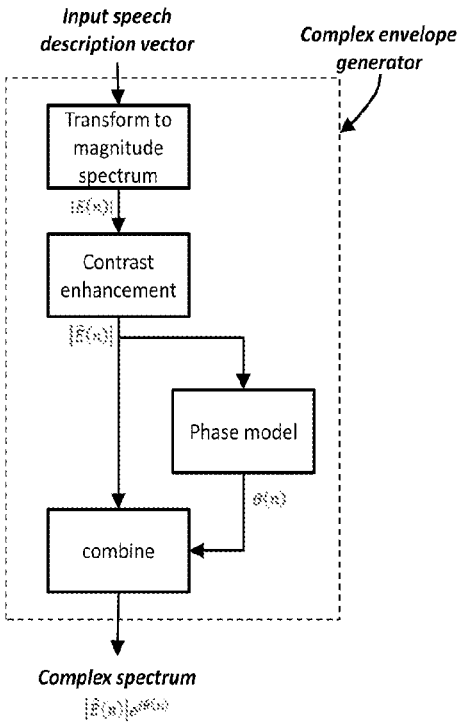
FIG. 8 is a detailed description of the complex envelope generator of FIGS. 6 and 7. It is a schematic diagram of a system that transforms a phaseless speech description vector into an enhanced complex spectrum. It contains a contrast enhancement system and a phase model.

FIG. 5 is a schematic diagram of the signal generation part of a speech synthesiser employing the embodiments of this invention. It describes an overlap-and-add (OLA) based synthesiser with constant window hop size. We will refer to this type of synthesis as frame synchronous synthesis. Frame synchronous synthesis has the advantage that the processing load of the synthesiser is less sensitive to the fundamental frequency F0. However, those skilled in the art of speech synthesis will understand that the techniques described in this invention can be used in other synthesis configurations such as pitch synchronous synthesis and synthesis by means of time varying source-filter models. The parameter to waveform transformation transforms a stream of input speech description vectors and a given F0 stream into a stream of short-time speech waveforms (samples). These short-time speech waveforms will be referred to as frames. Each short-time speech waveform is appropriately windowed where after it is overlapped with and added to the synthesis output sample stream. Two examples of a parameter to waveform implementation are shown in FIGS. 6 and 7. The speech description vector is transformed into a complex spectral envelope (the details are given in FIG. 8 and further on in the text) and multiplied with the complex excitation spectrum of the corresponding windowed excitation signal (FIG. 6). The spectral envelope is complex because it contains also information about the shape of the waveform. Apart from the first harmonics, the complex excitation spectrum contains mainly phase and energy information. It can be derived by taking the Fourier Transform of an appropriately windowed excitation signal. The excitation signal for voiced speech is typically a pulse train consisting of quasi-periodic pulse shaped waveforms such as Dirac, Rosenberg and Liljencrants-Fant pulses. The distance between successive pulses corresponds to the local pitch period. If the pulse train representation contains many zeroes (e.g. Dirac pulse train), it is more efficient to directly calculate the excitation spectrum without resorting to a full Fourier Transform. The multiplication of the spectra corresponds to a circular convolution of the envelope signal and excitation signal. This circular convolution can be made linear by increasing the resolution of the complex envelope and complex excitation spectrum. Finally an inverse Fourier transform (IFFT) converts the resulting complex spectrum into a short-time speech waveform. However, instead of spectrum multiplication, a Synchronized OverLap-and-Add (SOLA) scheme can be used (see FIG. 7). the SOLA approach has the advantage that linear convolution can be achieved by using a smaller FFT size with respect to the spectrum multiplication approach. Only the OLA buffer that is used for the SOLA should be of double size. Each time a frame is synthesised, the content of the OLA buffer is linearly shifted to the left by the window hop size and an equal number of zeroes are inserted at the end of the OLA buffer. The SOLA approach is computationally more efficient when compared to the spectrum multiplication approach because the (I)FFT transforms operate on shorter windows. The implicit waveform synchronization intrinsic to SOLA is beneficial for the reduction of the inter-frame phase jitter (see further). However, the SOLA method introduces spectral smearing because neighbouring pitch cycles are merged in the time domain. The spectral smearing can be avoided using pitch synchronous synthesis, where the pulse response (i.e. the IFFT of the product of the complex spectral envelope with the excitation spectrum) is overlapped-and-added pitch synchronously (i.e. by shifting the OLA buffer in a pitch synchronous fashion). The latter can be combined with other efficient techniques to reduce the inter-frame phase jitter (see further).

The complex envelope generator (FIG. 8) takes a speech description vector as input and transforms it into a magnitude spectrum $|E(n)|$. The spectral contrast of the magnitude spectrum is enhanced ($|\hat{E}(n)|$) and it is preferably used to construct a phase spectrum $\theta(n)$. Finally, the magnitude and preferably the phase spectra are combined to create a single complex spectrum $|\hat{E}(n)|e^{j\theta(n)}$.

Spectral Contrast Enhancement

Figure 9:
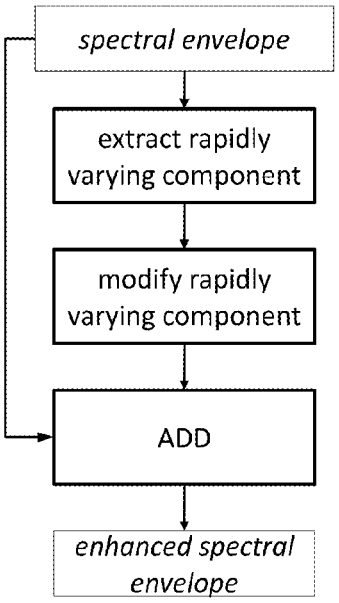
FIG. 9 is a schematic diagram of the spectral contrast enhancement system.

FIG. 9 shows an overview of the spectral contrast enhancement technique used in a number of embodiments of the first invention. First, a rapidly varying component is extracted from the spectral envelope. This component is then modified and added with the original spectral envelope to form an enhanced spectral envelope. The different steps in this process are explained below.

Decomposition

The non-constant coarse shape of the spectral envelope has the tendency to decrease with increasing frequency. This roll off phenomenon is called the spectral slope. The spectral slope is related to the open phase and return phase of the vocal folds and determines to a certain degree the brightness of the voice. The coarse shape does not convey much articulatory information. The spectral peaks (and associated valleys) that can be seen on the spectral envelope are called formants (and spectral troughs). They are mainly a function of the vocal tract that acts as a time varying acoustic filter. The formants, their locations and their relative strengths are important parameters that affect intelligibility and naturalness. As discussed in the prior art section, broadening of the formants has a negative impact on the intelligibility of the speech waveform. In order to improve the intelligibility it is important to manipulate the formants without altering the spectral envelope's coarse shape. Therefore the techniques discussed in this invention separate the spectral envelope into two components. A slowly varying component which corresponds to the coarse shape of the spectral envelope and a rapidly varying component which captures the essential formant information. The term "varying" does not describe a variation over time but variation over frequency in the angular frequency interval $\omega=[0,\pi]$. The decomposition of the spectral envelope in two components can be done in different ways.

Figure 10:
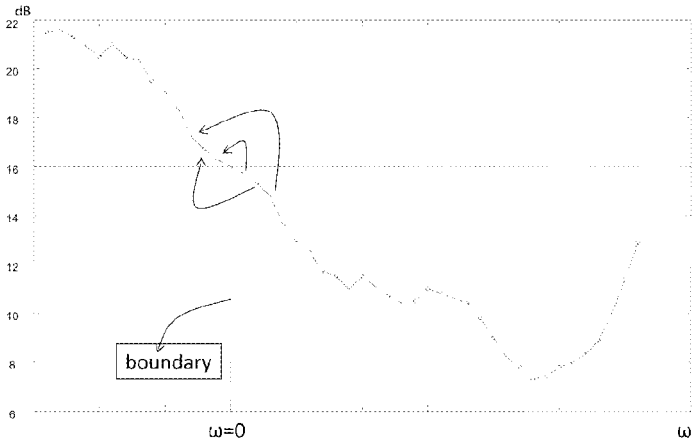
FIG. 10 is a graphical representation of the boundary extension used in the spectral envelope decomposition by means of zero-phase filters.
Figure 11:
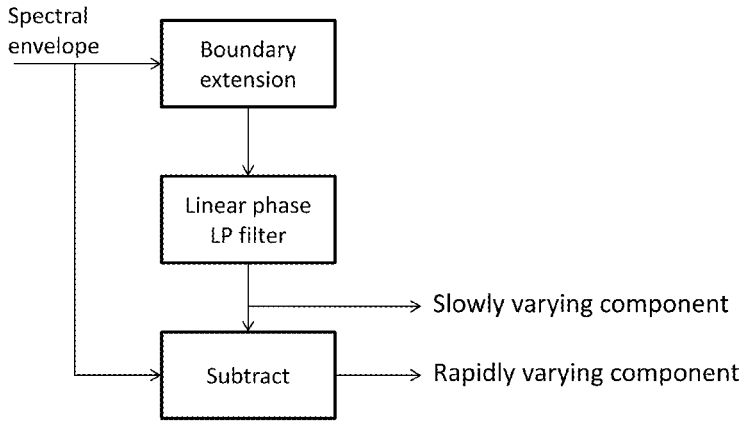
FIG. 11 is a schematic diagram of a spectral envelope decomposition technique based on a linear-phase LP filter implementation.

In one embodiment of this application a zero-phase low-pass (LP) filter is used to separate the spectral envelope representation in a rapidly varying component and in a slowly varying component. A zero-phase approach is required because the components after decomposition in a slowly and rapidly varying component should be aligned with the original spectral envelope and may not be affected by phase distortion that would be introduced by the use of other non-linear phase filters. In order to obtain a useful decomposition in the neighbourhood of the boundary points of the spectral envelope ($\omega=0$ and $\omega=\pi$), the envelope must be extended with suitable data points outside its boundaries. In what follows this will be referred to as boundary extension. In order to minimise boundary transients after filtering, the spectral envelope is mirrored around its end-points ($\omega=0$ and $\omega=\pi$) to create local anti-symmetry at its end points. In case the zero-phase LP filter is implemented as a linear phase finite impulse response (FIR) filter, delay compensation can be avoided by fixing the number of extended data points at each end-point to half of the filter order. An example of boundary extension at $\omega=0$ is shown in FIG. 10. By careful selection of the cut-off frequency of the zero-phase LP filter it is possible to decompose the spectral envelope into a slowly and rapidly varying component. The slowly varying component is the result after LP filtering while the rapidly varying component is obtained by subtracting the slowly varying component from the envelope spectrum (FIG. 11).

Figure 12:
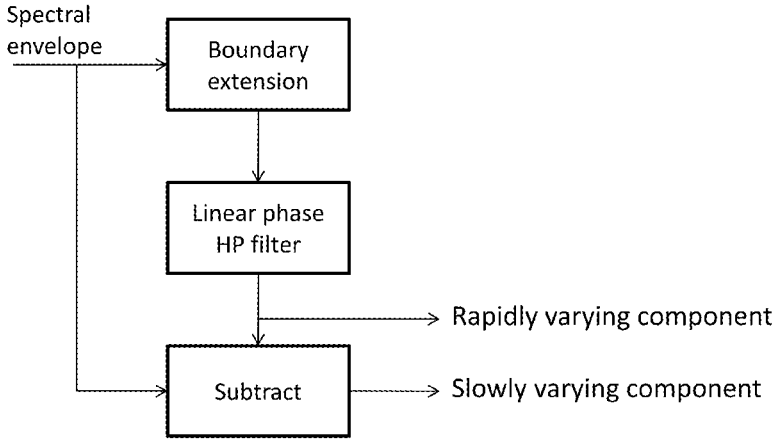
FIG. 12 is a schematic diagram of a spectral envelope decomposition technique based on a linear-phase HP filter implementation.

The decomposition process can also be done in a dual manner by means of a high pass (HP) zero-phase filter (FIG. 12). After applying the HP zero-phase filter to the boundary extended spectral envelope a rapidly varying component is obtained. The slowly varying component can be extracted by subtracting the rapidly varying component from the spectral envelope representation (FIG. 12). However it should be noted that the slowly varying component is not necessarily required in the spectral contrast enhancement (see for example FIG. 9).

Readers familiar with the art of signal processing will know that non-linear phase HP/LP filters can also be used to decompose the spectral envelope if the filtering is performed in positive and negative directions.

Figure 13:
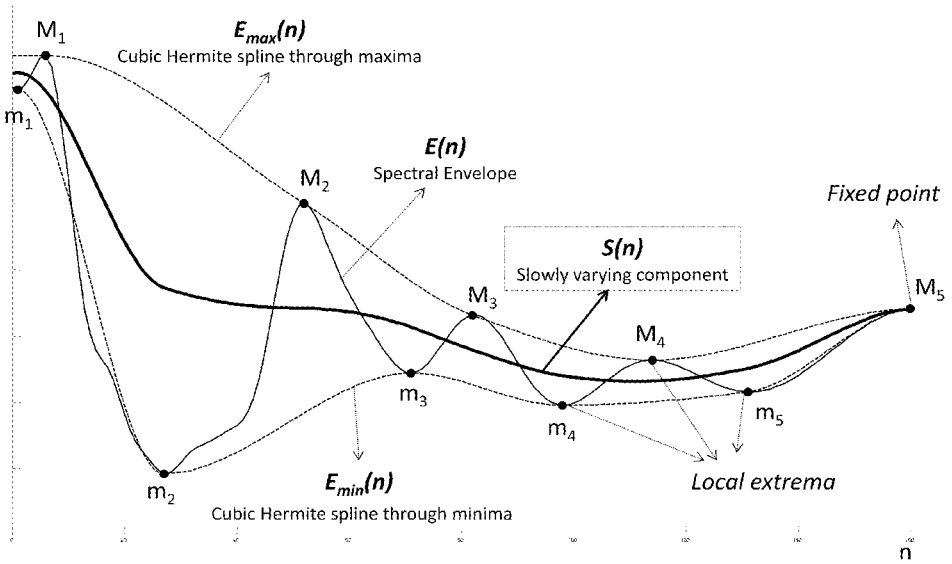
FIG. 13 shows a spectral envelope together with the cubic Hermite splines through the minima $m_x$ and maxima $M_x$ of the envelope and the corresponding slowly varying component. The horizontal axis represents frequency while the vertical axis represents the magnitude of the envelope in dB.
Figure 14:
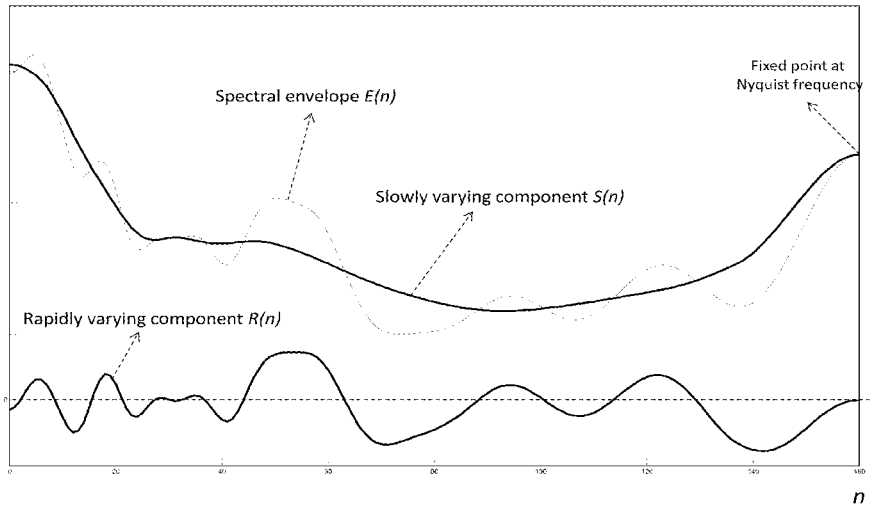
FIG. 14 shows another spectral envelope together with its slowly varying component and its rapidly varying component, where the rapidly varying component is zero at the fixed point at Nyquist frequency and the horizontal axis represents frequency (i.e. FFT bins) while the vertical axis represents the magnitude of the envelope in dB.

The filter-based approach requires substantial processing power and memory to achieve the required decomposition. This speed and memory issue is solved in a further embodiment which is based on a technique that finds the slowly varying component S(n) by averaging two interpolation functions. The first function interpolates the maxima of the spectral envelope while the second one interpolates the minima. The algorithm can be described by four elementary steps. This four step algorithm is fast and its speed depends mainly on the number of extrema of the spectral envelope. The decomposition process of the spectral envelope E(n) is presented in FIGS. 13 and 14. The four step algorithm is described below:

Step 1: determine all extrema of E(n) and classify them as minima or maxima

Step 2a: interpolate smoothly between minima resulting in a lower envelope $E_{min}(n)$ Step 2b: interpolate smoothly between maxima resulting in an upper envelope $E_{max}(n)$ Step 3: compute the slowly varying component by averaging the upper and lower envelopes:

$$S(n) = \frac{E_{min}(n) + E_{max}(n)}{2}$$

Step 4: extract the rapidly varying component R(n)=E(n)−S(n)

The detection of the extrema of E(n) is easily accomplished by differentiating E(n) and by checking for sign changes. Those familiar with the art of signal processing will know that there are many other techniques to determine the extrema of E(n). The processing time is linear in N, the size of the FFT.

In step2a and step2b a shape-preserving piecewise cubic Hermite interpolating polynomial is used as interpolation kernel [F. N. Fritsch and R. E. Carlson, "Monotone Piecewise Cubic Interpolation," SIAM Journal on Numerical Analysis, Vol. 17, pp. 238-246, 1980]. Other interpolation functions can also be used, but the shape-preserving cubic Hermite interpolating polynomial suffers less from overshoot and unwanted oscillations, when compared to other interpolants, especially when the interpolation points are not very smooth. An example of a decomposed spectral envelope is given in FIG. 13. The minima ($m_1, m_2 \ldots m_5$) of the spectral envelope E(n) are used to construct the cubic Hermite interpolating polynomial $E_{min}(n)$ and the maxima ($M_1, M_2 \ldots M_5$) of the spectral envelope E(n) lead to the construction of the cubic Hermite interpolating polynomial $E_{max}(n)$. The slowly varying component S(n) is determined by averaging $E_{min}(n)$ and $E_{max}(n)$. The spectral envelope is always symmetric at the Nyquist frequency. Therefore it will have an extremum at Nyquist frequency. This extremum is not a formant or spectral trough and should therefore not be treated as one. Therefore the algorithm will set the envelope at Nyquist frequency as a fixed point by forcing $E_{min}(n)$ and $E_{max}(n)$ to pass through the Nyquist point (see FIGS. 13 and 14). Therefore the rapidly varying component R(n) will always be zero at Nyquist frequency. The processing time of step2 is a function of the number of extrema of the spectral envelope. A similar fixed point can be provided at DC (zero frequency).

When the spectral variation is too high, it is useful to temper the frame-by-frame evolution of S(n). This can be achieved by calculating S(n) as the weighted sum of the current S(n) and a number of past spectra S(n−i) . . . S(n−1)'s. This is equivalent to a frame-by-frame low-pass filtering action.

Merging Rapidly and Slowly Varying Components

The spectral envelope is decomposed into a slowly and a rapidly varying component.

$$E(f)=S(f)+R(f)$$

The rapidly varying component contains mainly formant information, while the slowly varying component accounts for the spectral tilt. The enhanced spectrum can be obtained by combining the slowly varying component with the modified rapidly varying component.

$$E^{enh}(f)=S(f)+\tau(R(f)) \quad (2)$$

Figure 15:
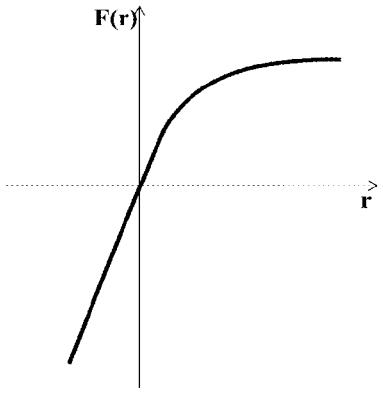
FIG. 15 represents a non-linear envelope transformation curve to modify the rapidly varying component into a modified rapidly varying component, where the transformation curve saturates for high input values towards the output threshold value T and the horizontal axis corresponds to the input amplitude of the rapidly varying component and the vertical axis corresponds to the output amplitude of the rapidly varying component after modification.
Figure 16:
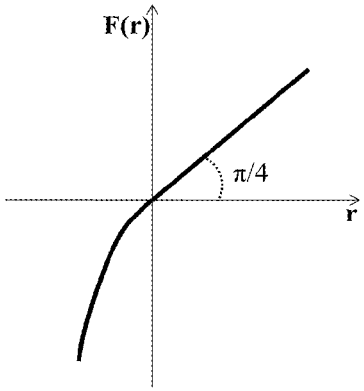
FIG. 16 represents a non-linear envelope transformation curve that modifies the rapidly varying component into a modified rapidly varying component, where the transformation curve amplifies the negative valleys of the rapidly varying component while it is transparent to its positive peaks and the horizontal axis corresponds to the input amplitude of the rapidly varying component and the vertical axis corresponds to the output amplitude of the rapidly varying component after modification.

In one embodiment of the invention, the rapidly varying component is linearly scaled by multiplying it by a factor α larger than one: $\tau(R(f))=\alpha R(f)$. Linear scaling sharpens the peaks and deepens the spectral troughs. In another embodiment of the invention a non-linear scaling function is used in order to provide more flexibility. In this way it is possible to scale the peaks and valleys non-uniformly. By applying a saturation function (e.g. $\tau(r)=F(r)$ in FIG. 15) to the rapidly varying component R(f) to the weaker peaks can be sharpened more than the stronger ones. If the speech enhancement application focuses on noise reduction it is useful to deepen the spectral troughs without modifying the strength of its peaks (a possible transformation function $\tau(r)=F(r)$ is shown in FIG. 16).

Because we do not modify the slowly varying component, the enhanced spectrum can be obtained by adding a modified version of the rapidly varying spectral envelope to the original envelope.

$$E^{enh}(f)E(f)+\hat{\tau}(R(f)) \quad (3)$$

With $\hat{\tau}(R(f))=\tau(R(f))-R(f)$

In one embodiment of the invention, $\hat{\tau}_0(R(f))=\alpha R(f)$. In this simplest case, the contrast enhancement is obtained by upscaling the formants and downscaling the spectral troughs.

Figure 19:
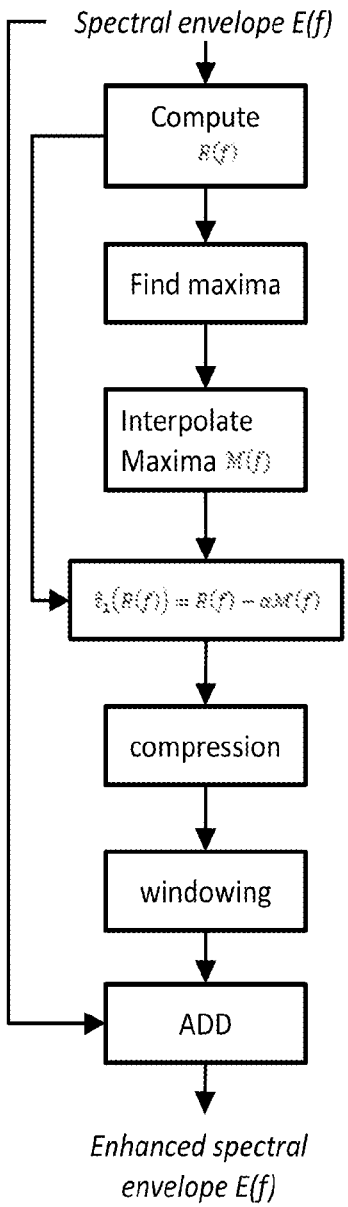
FIG. 19 shows the different steps in a spectral contrast enhancer.
Figure 20:
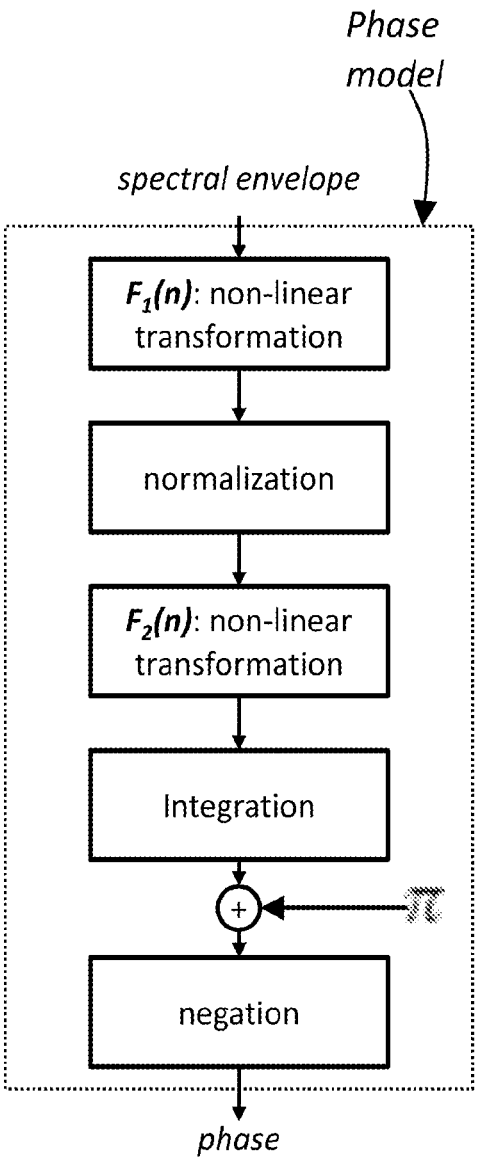
FIG. 20 shows how the phase component of the complex spectrum is calculated from the magnitude spectral envelope in case of voiced speech.

In another embodiment of the invention the calculation of $\hat{\tau}(R(f))$ aims at deepening the spectral troughs and consists of five steps (FIG. 19):

Step 1: Find the maxima $\{M_1 \ldots M_K\}$ of R(f)

Step 2: Interpolate the maxima $\{M_1 \ldots M_K\}$ by means of a smooth spline function $\mathcal{M}_+(f)$ Step 3: Subtract the spline function $\mathcal{M}_+(f)$ from the rapidly varying component R(f) to form $\hat{\tau}_1(R(f))=R(f)-\alpha\mathcal{M}_+(f)$. α is a scalar in the range [0 . . . 1]. The operation of adding $\hat{\tau}_1^+(R(f))$ to E(f) is an invariant operation for the formant peak values when α=1. In general when α∈[0,1], the excursion of $\hat{\tau}_1^+(R(f))$ at the formant frequencies is attenuated when compared to R(f). Therefore adding $\hat{\tau}_1^+(R(f))$ to E(f) will result in a spectral envelope where the deepening of the spectral troughs is more emphasized than the amplification of the formants.

Figure 17:
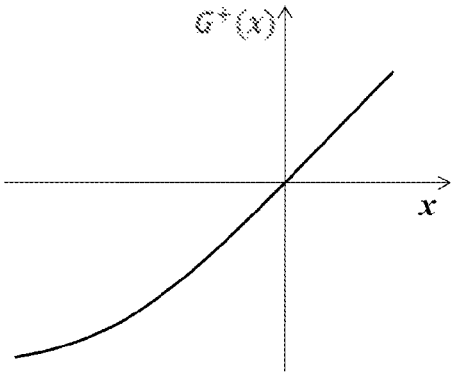
FIG. 17 is an example of a compression function $G^+$ that reduces the dynamic range of the troughs its input.

Step 4: Apply a compression function which looks like the function of FIG. 17 to $\hat{\tau}_1$ to obtain $\hat{\tau}_2^+(R(f))=G(\hat{\tau}_1^+(R(f))$. The compression function reduces the dynamic range of the troughs in $\hat{\tau}_2^+(R(f))$ Step 5: Apply a frequency dependent positive-valued scaling function $W^+(f)$ to $\hat{\tau}_2^{\tau+}$ in order to selectively deepen the spectral troughs: $\hat{\tau}_3^+(R(f))=\hat{\tau}_2^+(R(f))W^+(f)$. The frequency dependency of $W^+(f)$ is used to control the frequency regions where a deepening of the spectral troughs is required Those skilled in the art of speech processing will understand that enhancement will be obtained if $\hat{\tau}_1^+$ for $\hat{\tau}_2^+$ are added to the spectral envelope. Therefore one should regard steps 4 and 5 as optional. However, it should be noted that steps 4 and 5 increase the controllability of the algorithm.

In another embodiment of the invention, $\hat{\tau}(R(f))$ is used for frequency selective amplification of the formant peaks. Its construction is similar to the previous construction to deepen the spectral troughs. $\hat{\tau}(R(f))$ is constructed as follows:

Step 1: Find the minima $\{m_1 \ldots m_K\}$ of R(f)

Step 2: Interpolate the minima $\{m_1 \ldots m_K\}$ by means of a smooth spline function $\mathcal{M}_-(f)$ Step 3: Distract the spline function $\mathcal{M}_-(f)$ from the rapidly varying component R(f) to form $\hat{\tau}_1^-(R(f))=R(f)-\alpha\mathcal{M}(f)$. α is a frequency selective scalar varying between 0 and 1. The operation of adding $\hat{\tau}(R(f))$ to E(f) is an invariant operation to the spectral troughs when α=1. In general when α∈[0,1], the excursion of $\hat{\tau}_1^+(R(f))$ at the frequencies corresponding to the spectral troughs is attenuated when compared to R(f). Therefore adding $\hat{\tau}_1^+(R(f))$ to E(f) will result in a spectral envelope where the amplification of the spectral formant peaks is more emphasized than the deepening fo the spectral troughs.

Figure 18:
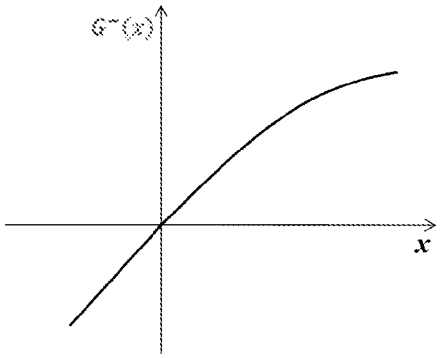
FIG. 18 is an example of a compression function $G^-$ that reduces the dynamic range of the peaks of its input.

Step 4: apply a compression function which looks like the function of FIG. 18 to $\hat{\tau}_1^-$ to obtain $\hat{\tau}_2^-(R)f))=G^-(\hat{\tau}_1^-(R(f))$. The compression function reduces the dynamic range of the peaks in $\hat{\tau}_2^-(R(f))$ Step 5: apply a frequency dependent positive-valued scaling function $W^-(f)$ to $\hat{\tau}_2^-$ in order to selectively amplify the formant peaks: $\hat{\tau}_3^-(R(f))=\hat{\tau}_2^-(R(f))W^-(f)$. The frequency dependency of $W^-(f)$ is used to control the frequency regions where a amplification of the formant peaks is required.

The remarks that were made about $\hat{\tau}_1^+$ and $\hat{\tau}_2^+$ are also valid for $\hat{\tau}_1^-$ and $\hat{\tau}_2^-$.

The two algorithms can be combined together to independently modify the peaks and troughs in frequency regions of interest. The frequency regions of interest can be different in the two cases.

The enhancement is preferably done in the log-spectral domain; however it can also be done in other domains such as the spectral magnitude domain.

In HMM based speech synthesis, spectral contrast enhancement can be applied on the spectra derived from the smoothed MFCCs (on-line approach) or directly to the model parameters (off-line approach). When it is performed on-line, the slowly varying components can be smoothed during synthesis (as described earlier). In an off-line process the PDF's obtained after training and clustering can be enhanced independently (without smoothing). This results in a substantial increase of the computational efficiency of the synthesis engine.

Phase Model

The second invention is related to deriving the phase from the group delay. In order to reduce buzziness during voiced speech, it is important to provide a natural degree of waveform variation between successive pitch cycles. It is possible to couple the degree of inter-cycle phase variation to the degree of inter-cycle magnitude variation. The minimum phase representation is a good example. However, the minimum phase model is not appropriate for all speech sounds because it is an oversimplification of reality. In one embodiment of our invention we model the group delay of the spectral envelope as a function of the magnitude envelope. In that model it is assumed that the group delay spectrum has a similar shape as the magnitude envelope spectrum.

The group delay spectrum $\tau(f)$ is defined as the negative derivative of the phase.

$$\tau(f) = -\frac{d\theta(f)}{df}$$

If the number of frequency bins is large enough, the differentiation operator in $$\frac{d.}{df}$$

can be successfully approximated by the difference operator $\Delta$ in the discrete frequency domain:

$$\tau(n) = -\Delta\theta(n)$$

A first monotonously increasing non-linear transformation $F_1(n)$ with positive curvature can be used to sharpen the spectral peaks of the spectral envelope. In an embodiment of this invention a cubic polynomial is used for that. In order to restrict the bin-to-bin phase variation, the group delay spectrum is first scaled. The scaling is done by normalising the maximum amplitude in such a way that its maximum corresponds to a threshold (e.g. $\pi/2$ is a good choice).

Figure 21:
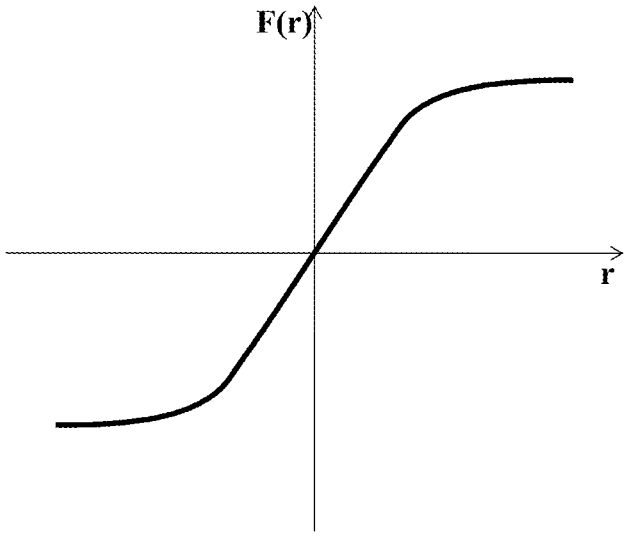
FIG. 21 shows a sigmoid-like function.

The normalisation is followed by an optional non-linear transformation $F_2(n)$ which is typically implemented through a sigmoidal function (FIG. 21) such as the linearly scaled logistic function. Transformation $F_2(n)$ increases the relative strength of the weaker formants. In order to obtain a signal with high amplitudes in the centre and low ones at its edges, $\pi$ is added to the group delay.

$$\tau(n) = F_2\left(\frac{\pi}{2}\frac{F_1(E(n))}{\max_{m\in[0,N]}(F_1(E(m)))}\right) + \pi \quad (4)$$

Finally, $\tau(n)$ is integrated and its sign is reversed resulting in the model phase:

$$\theta(n) = -\Sigma_{k=0}^{n}\tau(k) \quad (5)$$

The sign reversal can be implemented earlier or later in the processing chain or it can be included in one of the two non-linear transformations. It should be noted that the two non-linear transformations are optional (i.e. acceptable results are also obtained by skipping those transformations).

Figure 22:
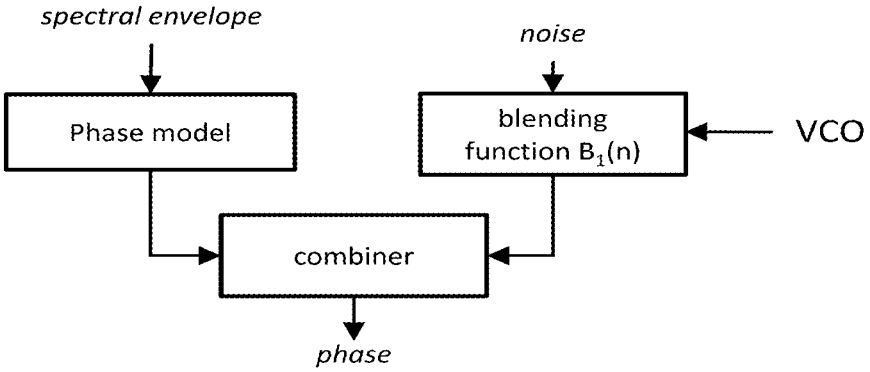
FIG. 22 shows how noise is merged into the phase component to form a phase component that can be used to produced mixed voicing.

In a specific embodiment of this invention, phase noise is introduced (see FIG. 22). Cycle-to-cycle phase variation is not the only noise source in a realistic speech production system. Often breathiness can be observed in the higher regions of the spectrum. Therefore, noise weighted with a blending function $B_1(n)$ is added to the deterministic phase component $\theta(n)$ (FIG. 22). The blending function $B_1(n)$ can be any increasing function, for example a unit-step function, a piece-wise linear function, the first half of a Hanning window etc. The start position of the blending function $B_1(n)$ is controlled by a voicing cut-off (VCO) frequency parameter (see FIG. 22). The voicing cut-off (VCO) frequency parameter specifies a value above which noise is added to the model phase. The summation of noise with the model phase is done in the combiner of FIG. 22. The VCO frequency is either obtained through analysis (e.g. K. Hermus et al, "Estimation of the Voicing Cut-Off Frequency Contour Based on a Cumulative Harmonicity Score", IEEE Signal processing letters, Vol. 14, Issue 11, pp 820-823, 2007), (phoneme dependent) modelling or training (the VCO frequency parameter is just like F0 and MFCC well suited for HMM based training). The underlying group delay function that is used in our phase model is a function of the spectral energy. If the energy is changed by a certain factor, the phase (and as a consequence the waveform shape) will be altered. This result can be used to simulate the effect of vocal effort on the waveform shape.

In the above model, the phase will fluctuate from frame to frame. The degree of fluctuation depends on the local spectral dynamics. The more the spectrum varies between consecutive frames, the more the phase fluctuates. The phase fluctuation has an impact on the offset and the wave shape of the resulting time-domain representation. The variation of the offset, often termed as jitter, is a source of noise in voiced speech. An excessive amount of jitter in voiced speech leads to speech with a pathological voice quality. This issue can be solved in a number of ways:

- By smoothing the model phase of voiced frames: The phase for a given voiced frame can be calculated as a weighted sum of the model phase (5) of the given frame and the model phases of a number of its voiced neighbouring frames. This corresponds to an FIR smoothing. Accumulative smoothers such as IIR smoothers can also efficiently reduce phase jitter. Accumulative smoothers often require less memory and calculate the smoothed phase for a given frame based as the weighted sum of a number of smoothed phases from previous frames and the model phase of the given frame. A first order accumulative smoother is already effective and takes into account only one previous frame. This reduces the required memory and maximizes its computational efficiency. In order to avoid harmonization artefacts in unvoiced speech, smoothing should be restricted to voiced frames only.
- By adding a frame specific correction value to each group delay in such a way that the inter-frame variation of the average group delay is minimal.
- By adding a frame specific correction value to each group delay in such a way that the inter-frame variation of the energy-weighted group delay is minimal. This is equivalent to synchronization on the center-of-energy (in the time domain)

By waveform synchronisation of consecutive short-time waveform segments based on measures such as correlation analysis, specific time-domain features such as the center-of-gravity, the center-of-energy etc.

By frame synchronous synthesis with a window hop size which is small when compared with the synthesis window (see higher for more details).

A Trainable Phase Model

The third invention is related to the use of a complex cepstrum representation. It is possible to reconstruct the original signal from a phaseless parameter representation if some knowledge on the phase behaviour is known (e.g. linear phase, minimum phase, maximum phase). In those situations there is a clear relation between the magnitude spectrum and the phase spectrum (for example the phase spectrum of a minimum phase signal is the Hilbert transform of its log-magnitude spectrum). However, the phase spectrum of a short-time windowed speech segment is of a mixed nature. It contains a minimum and a maximum phase component.

The Z-transform of each short-time windowed speech frame of length N+1 is a polynomial of order N. If $s_k k\epsilon[0 \ldots N]$ is the windowed speech segment, its Z-transform polynomial can be written as:

$$H(z) = \sum_{k=0}^{N} s_k z^{-k}$$

The polynomial H(z) is uniquely described by its N complex zeroes $z_k$ and a gain factor A $$H(z) = \sum_{k=0}^{N} s_k z^{-k} = A\prod_{k=1}^{N} (1 - z_k z^{-1})$$

Some of its zeroes ($K_I$) are located inside the unit circle ($z_k^I$) while the remainder ($K_O$=N−$K_I$) is located outside the unit circle ($z_k^o$):

$$H(z) = A\prod_{k=1}^{K_I} (1 - z_k^I z^{-1})\prod_{k=1}^{K_O} (1 - z_k^O z^{-1}) = AH_I(z)H_O(z)$$

The first factor $H_I(z)=\Pi_{k=1}^{K_I}(1-z_k^I z^{-1})$ corresponds to a minimum phase system while the second factor $H_O(z)=\Pi_{k=1}^{K_O}(1-z_k^O z^{-1})$ corresponds to a maximum phase system (combined with a linear phase shift) and $A=s_0$. In the general case also zeroes on the unit circle should be considered in this discussion. However, a detailed discussion of this specific case would not be beneficial for the clarity for this application.

The magnitude or power spectrum representation of the minimum and maximum phase spectral factors can be transformed to the Mel-frequency scale and approximated by two MFCC vectors. The two MFCC vectors allow for recovering the phase of the waveform using two magnitude spectral shapes. Because the phase information is made available through polynomial factorisation, the minimum and maximum phase MFCC vectors are highly sensitive to the location and the size of the time-domain analysis window. A shift of a few samples may result in a substantial change of the two vectors. This sensitivity is undesirable in coding or modelling applications. In order to reduce this sensitivity, consecutive analysis windows must be positioned in such a way that the waveform similarity between the windows is optimised.

An alternative way to decompose a short-time windowed speech segment into a minimum and maximum phase component is provided by the complex cepstrum. The complex cepstrum can be calculated as follows: Each short-time windowed speech signal is padded with zeroes and the Fast Fourier Transform (FFT) is performed. The FFT produces a complex spectrum consisting of a magnitude and a phase spectrum. The logarithm of the complex spectrum is again complex, where the real part corresponds to the log-magnitude envelope and the imaginary part corresponds to the unwrapped phase. The Inverse Fast Fourier Transform (IFFT) of the log complex spectrum results in the so-called complex cepstrum [Oppenheim & Schaffer, "Digital Signal Processing", Prentice-Hall, 1975]. Due to the symmetry properties of the log complex spectrum, the imaginary component of the complex cepstrum is in fact zero. Therefore the complex cepstrum is a vector of real numbers.

A minimum phase system has all of its zeroes and singularities located inside the unit circle. The response function of a minimum phase system is a complex minimum phase spectrum. The logarithm of the complex minimum phase spectrum again represents a minimum phase system because the locations of its singularities correspond to the locations of the initial zeroes and singularities. Furthermore, the cepstrum of a minimum phase system is causal and the amplitude of its coefficients has a tendency to decrease as the index increases. Reversely, a maximum phase system is anti-causal and the cepstral values have a tendency to decrease in amplitude as the indices decrease.

The complex cepstrum of a mixed phase system is the sum of a minimum phase and a maximum phase system. The first half of the complex cepstrum corresponds mainly to the minimum phase component of the short-time windowed speech waveform and the second half of the complex cepstrum corresponds mainly to the maximum phase component. If the cepstrum is sufficiently long, that is if the short-time windowed speech signal was padded with sufficient zeroes, the contribution of the minimum phase component in the second half of the complex cepstrum is negligible, and the contribution of the maximum phase component on the first half of the complex spectrum is also negligible. Because the energy of the relevant signal features is mainly compacted into the lower order coefficients, the dimensionality can be reduced with minimal loss of speech quality by windowing and truncating the two components of the complex cepstrum.

The complex cepstrum representation can be made more efficient from a perceptual point of view by transforming it to the Mel-frequency scale. The bilinear transform (1) maps the linear frequency scale to the Mel-frequency scale and does not change the minimum/maximum phase behaviour of its spectral factors. This property is a direct consequence of the "maximum modulus principle" of holomorphic functions and the fact that the unit circle is invariant under bilinear transformation.

Figure 24:
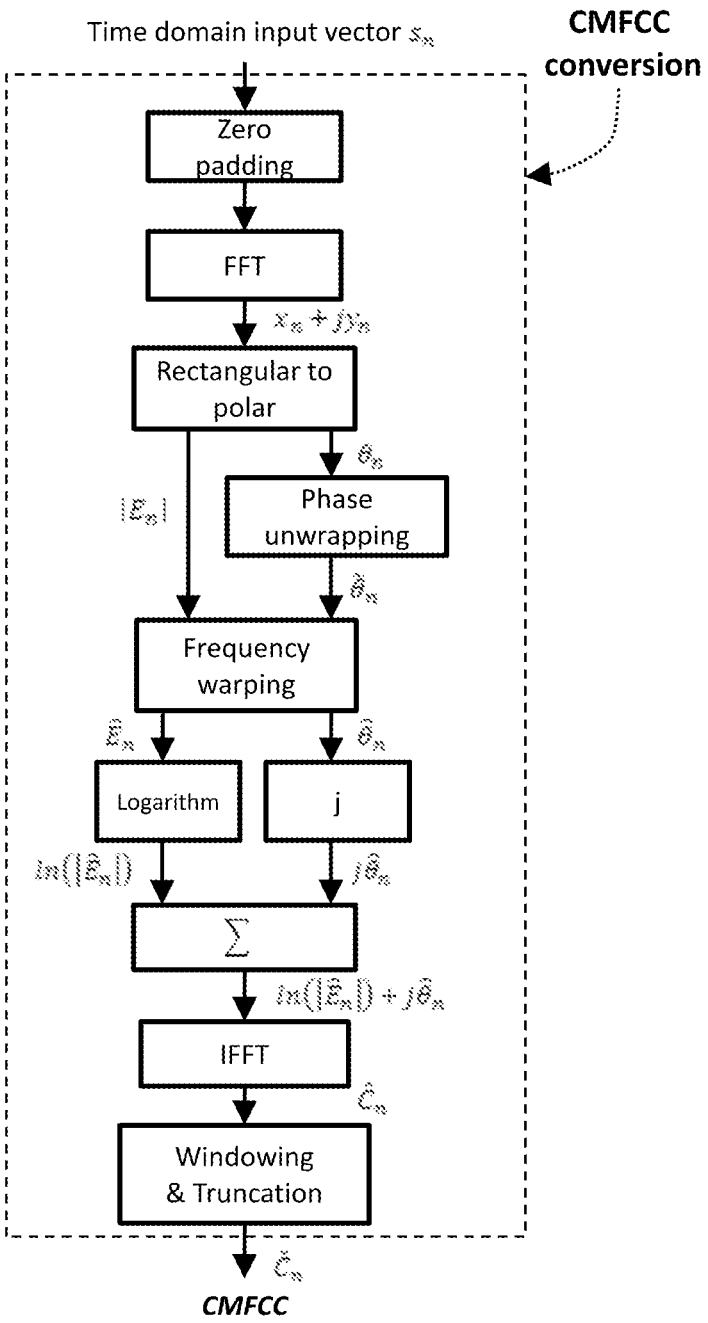
FIG. 24 shows how a short time signal can be converted to a CMFCC representation

Calculating the complex spectrum from the Mel-warped complex spectrum produces a vector with Complex Mel-Frequency Cepstral Coefficients (CMFCC). The conversion of a short-time pitch synchronously windowed signal $s_n$ to its CMFCC representation is shown in FIG. 24. In order to minimise cepstral aliasing, the pitch synchronously windowed signal $s_n$ $n\epsilon[0, N-1]$ is padded with zeroes before taking the FFT. The output of the FFT is a vector with complex coefficients $x_n+jy_n$ which will be referred to as the natural spectrum. In order to warp the natural spectrum, which is defined at a linear frequency scale, to the Mel-frequency scale, its complex representation ($x_n+jy_n$) is first converted to polar representation: $|E_n|e^{j\theta_n}$ in order to warp the magnitude and the phase spectrum. Because speech signals are real signals, the discussion can be limited to first half of the spectrum representation (i.e. coefficients $$k \in \left[0 \ldots \frac{N}{2}\right]$$

with N the size of the FFT). The k-th coefficient (counting starts at zero) from the magnitude and phase spectrum vector representation correspond to the angular frequency $$\frac{2k}{N}\pi.$$

In other words, the magnitude and phase spectrum coefficients have an equidistant representation on the frequency axis. The frequency warping of the natural magnitude spectrum $|E_n|$ from a linear scale to a Mel-like scale such as the one defined by the bilinear transform (1) is straightforward and can be realised by interpolating the coefficients of the natural magnitude spectrum $|E_k|$ that are defined at a number of equidistant frequency points at a new set of points that are obtained by transforming a second set of equidistant points by a function that implements the inverse frequency mapping (i.e. Mel-like scale to linear scale mapping). The interpolation can be efficiently implemented by means of a lookup table in combination with linear interpolation. The magnitude of the warped spectrum is compressed by means of a magnitude compression function. The standard CMFCC calculation as described in this application uses the Neperian logarithmic function as magnitude compression function. However, it should be noted that CMFCC variants can be generated by using other magnitude compression functions. The Neperian logarithmic function compresses the magnitude spectrum $|E_n|$ to the log-magnitude spectrum $\ln(|\hat{E}_n|)$. The composition of the frequency warping and the compression function is commutative when high precision arithmetic is used. However in fixed-point implementations higher precision will be obtained if compression is applied before frequency warping.

The frequency warping of the phase $\theta_n$ is less trivial. Because the phase is multi-valued (it has multiplicity $2k\pi$ with k=0, 1, 2 . . . ) it cannot be directly used in an interpolation scheme. In order to achieve meaningful interpolation results, continuity is required. This can be accomplished by means of phase unwrapping which transforms the phase $\theta_n$ into the unwrapped phase $\tilde{\theta}_n$. After frequency warping of $\tilde{\theta}_n$, the warped phase function $\hat{\theta}_n$ remains continuous and represents the imaginary component of the natural logarithm of the warped spectrum. The inverse Fourier Transform (IFFT) of the warped compressed spectrum $\ln(|\hat{E}_n|)+j\hat{\theta}_n$ leads to the complex cepstrum $\hat{C}_n$, whose imaginary componenent is zero. Analogous to the FFT, the IFFT projects the warped compressed spectrum onto a set of orthonormal (trigonometric) basis vectors. Finally, the dimensionality of the vector $\hat{C}$ is reduced by windowing and truncation to create the compact CMFCC representation $\check{C}$.

In what follows it is assumed that the minimum and maximum phase components of $\check{C}$ are represented by $M_I$ and $M_O$ coefficients respectively.

$$\check{C} = \left[c_0\ c_1^I\ c_2^I \cdots c_{M_I}^I\ \underbrace{0 \cdots 0}_{K-M_I-M_O-1}\ c_{M_O}^O \cdots c_2^O\ c_1^O\right] \tag{6}$$

The time-domain speech signal s is reconstructed by calculating: $s=\mathrm{IFFT}(e^{FFT(\check{C})})$. The signal s corresponds to the circular convolution of its minimum and maximum phase components. By choosing the FFT length K in (6) large enough, the circular convolution converges to a linear convolution.

Figure 23:
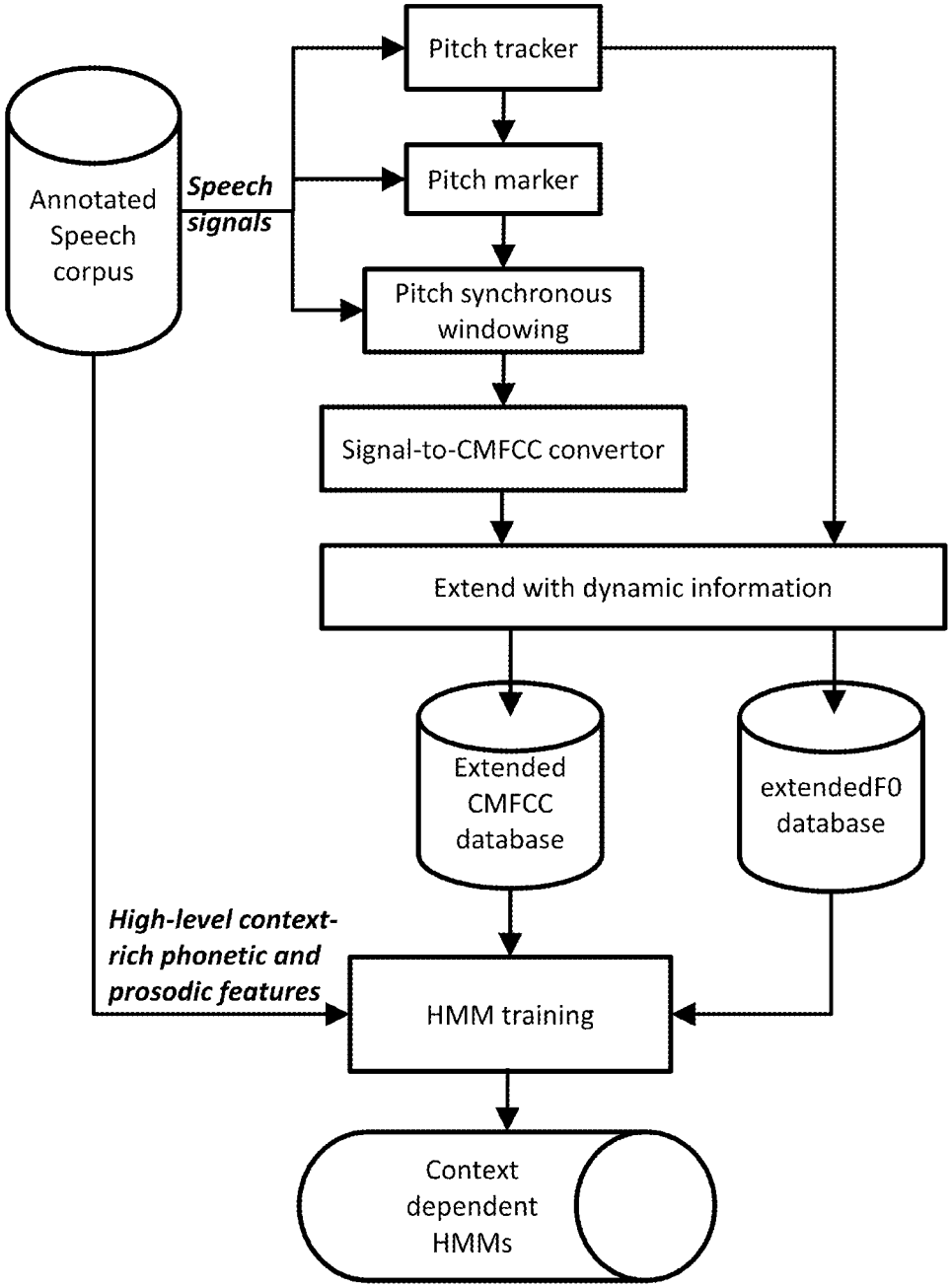
FIG. 23 is a schematic description of the feature extraction and training for a trainable text-to-speech system

An overview of the combined CMFCC feature extraction and training is shown in FIG. 23. The calculation of CMFCC feature vectors from short-time speech segments will be referred to as speech analysis. Phase consistency between voiced speech segments is important in applications where speech segments are concatenated (such as TTS) because phase discontinuities at voiced segment boundaries cause audible artefacts. Because phase is encoded into the CMFCC vectors, it is important that the CMFCC vectors are extracted in a consistent way. Consistency can be achieved by locating anchor points that indicate periodic or quasi-periodic events. These events are derived from signal features that are consistent over all speech utterances. Common signal features that are used for finding consistent anchor points are among others the location of the maximum signal peaks, the location of the maximum short-time energy peaks, the location the maximum amplitude of the first harmonic, the instances of glottal closure (measured by an electro glottograph or analysed (e.g. P. A. Naylor, et al. "Estimation of Glottal Closure Instants in Voiced Speech using the DYPSA Algorithm," IEEE Trans on Speech and Audio Processing, vol. 15, pp. 34-43, January 2007)). The pitch cycles of voiced speech are quasi-periodic and the wave shape of each quasi-period generally varies slowly over time. A first step in finding consistent anchor points for successive windows is the extraction of the pitch of the voiced parts of the speech signals contained in the speech corpus. Those familiar with the art of speech processing will know that a variety of pitch trackers can be used to accomplish this task. In a second step, pitch synchronous anchor points are located by a pitch marker algorithm (FIG. 23). The anchor points provide consistency. Those familiar with TD-PSOLA synthesis will know that a variety of pitch marking algorithms can be used. Once the pitch synchronous anchor points are detected, the voiced parts of the speech signal are pitch synchronously windowed. In a preferred embodiment of the invention, successive windows are centred at pitch-synchronous anchor points. Experiments have shown that a good choice for the window is a two pitch periods long Hamming window, but other windows also give satisfactory results. Each short-time pitch synchronously windowed signal $s_n$ is then converted to a CMFCC vector by means of the signal-to-CMFCC converter of FIG. 23. The CMFCCs are re-synchronised to equidistant frames. This re-synchronisation can be achieved by choosing for each equidistant frame the closest pitch-synchronous frame, or using other mapping schemes such as linear- and higher order interpolation schemes. For each frame the delta and delta-delta vectors are calculated to extend the CMFCC vectors and F0 values with dynamic information (FIG. 23). The procedure described above is used to convert the annotated speech corpus of FIG. 23 into a database of extended CMFCC and F0 vectors. At the annotation level, each phoneme is represented by a vector of high-level context-rich phonetic and prosodic features. The database of extended CMFCCs and F0s is used to generate a set of context dependent Hidden Markov Models (HMM)

through a training process that is state of the art in speech recognition. It consists of aligning triphone HMM states with the database of extended MFCC's and F0's, estimating the parameters of the HMM states, and decision-tree based clustering the trained HMM states according to the high-level context-rich phonetic and prosodic features.

Figure 25:
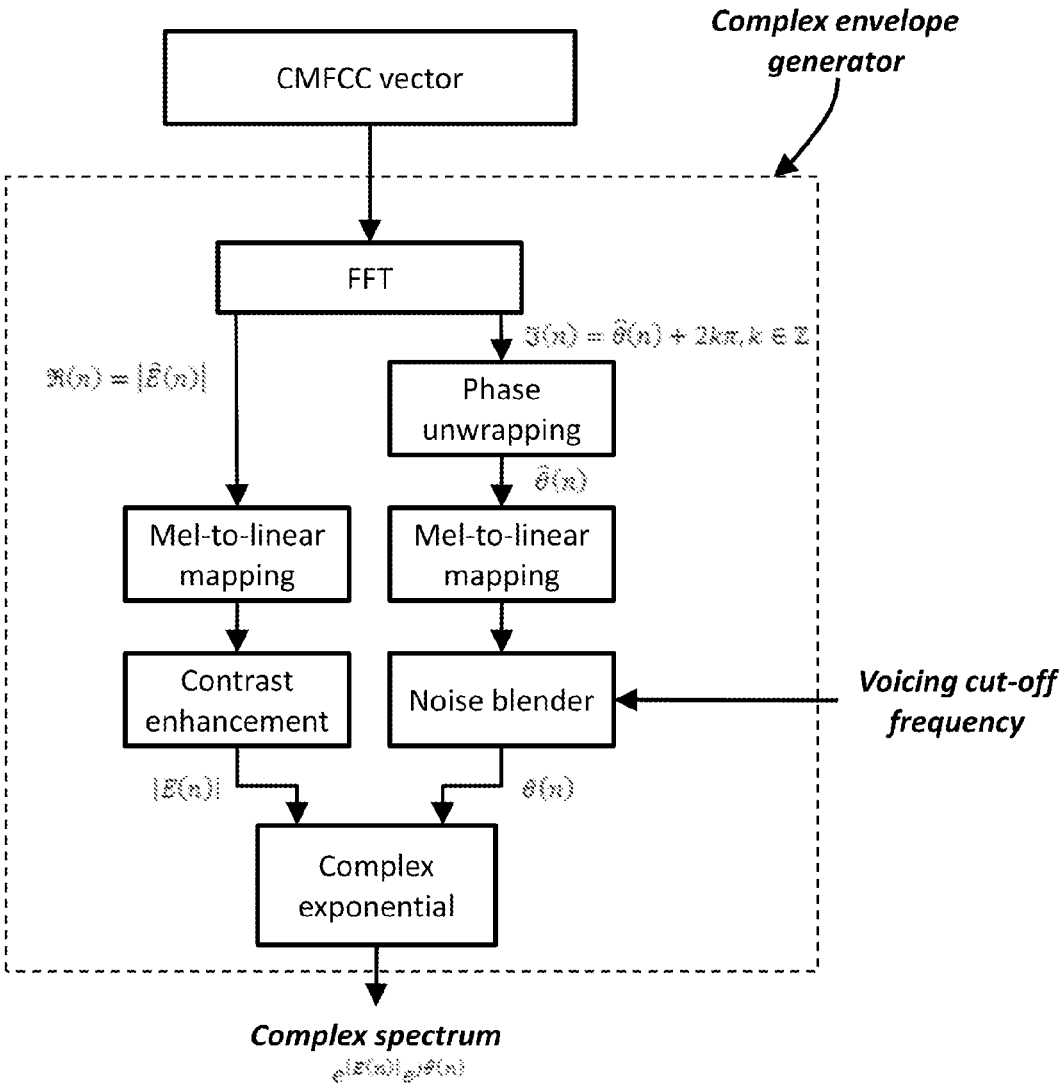
FIG. 25 shows how a CMFCC representation can be converted to a complex spectrum representation

The complex envelope generator of an HMM based synthesiser based on CMFCC speech representation is shown in FIG. 25. The process of converting the CMFCC speech description vector to a natural spectral representation will be referred to as synthesis. The CMFCC vector is transformed into a complex vector by applying an FFT.

$$FFT(\check{C})=\Re(n)+j\Im(n)$$

The real part $\Re$ (n) corresponds to the Mel-warped log-magnitude of the spectral envelope $|\hat{E}(n)|$ and an imaginary part $\Im(n)=\hat{\theta}(n)+2k\pi$, $k\in\mathbb{Z}$ corresponds to the wrapped Mel-warped phase. Phase unwrapping is required to perform frequency warping. The wrapped phase $\Im(n)$ is converted to its continuous unwrapped representation $\hat{\theta}(n)$. In order to synthesise it is necessary to transform the log-magnitude and the phase from the Mel-frequency scale to the linear frequency scale. This is accomplished by the Mel-to-linear mapping building block of FIG. 25. This mapping interpolates the magnitude and phase representation of the spectrum defined on a non-linear frequency scale such as a Mel-like frequency scale defined by the bilinear transform (1) at a number of frequency points to a linear frequency scale. The Mel-to-linear mapping will be referred to as Mel-to-linear frequency warping. Ideally, the Mel-to-linear frequency warping function from synthesis and the linear-to-Mel frequency warping function from analysis are each other's inverse.

The optional noise blender (FIG. 25) merges noise into the higher frequency bins of the phase to obtain a mixed phase (n). As explained above, a number of different noise blending strategies can be used. For efficiency reasons, the preferred embodiment uses a step function as noise blending function. The voicing cut-off frequency is used as a parameter to control the point where the step occurs. The spectral contrast of the envelope magnitude spectrum can be further enhanced by techniques discussed in previous paragraphs of the detailed description describing the first invention. This results in a compressed magnitude spectrum $|E(n)|$. The spectral contrast enhancement component is optional and its use depends mainly on the application. Finally, the mixed phase $\theta(n)$ is rotated by 90 degrees in the complex plane and added to the enhanced compressed spectrum $|E(n)|$. After calculating the complex exponential the complex spectrum $e^{|E(m)|}\cdot e^{j\theta(n)}$ is generated. The complex exponential acts as an expansion function that expands the magnitude of the compressed spectrum to its natural representation. Ideally, the compression function of the analysis and expansion function used in synthesis are each other's inverse. The complex exponential is a magnitude expansion function. Finally, the IFFT of the complex spectrum produces the short-time speech wave form s. It should be noted that other magnitude expansion functions could be used if the analysis (i.e. signal-to-CMFCC conversion) was done with a magnitude compression function which equals the inverse of the magnitude expansion function.

In concatenative speech synthesis, CMFCC's can be used as an efficient way to represent speech segments from the speech segment data base. The short-time pitch synchronous speech segments used in a TD-PSOLA like framework can be replaced by the more efficient CMFCC's. Besides their storage efficiency, the CMFCC's are very useful for pitch synchronous waveform interpolation. The interpolation of the CMFCC's interpolates the magnitude spectrum as well as the phase spectrum. It is well known that the TD-PSOLA prosody modification technique repeats short pitch-synchronous waveform segments when the target duration is stretched. A rate modification factor of 0.5 or less causes buzziness because the waveform repetition rate is too high. This repetition rate in voiced speech can be avoided by interpolating the CMFCC vector representation of the corresponding short waveform segments. Interpolation over voicing boundaries should be avoided (anyhow, there is no reason to stretch speech at voicing boundaries).

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilise the invention and various embodiments with various modifications as are suited to the particular use contemplated. It is intended that the scope of the invention be defined by the claims appended hereto and their equivalents.

The invention claimed is:

1. A method for providing spectral speech descriptions to be used for synthesis of a speech utterance comprising the steps of receiving at least one spectral envelope input representation corresponding to the speech utterance, where the at least one spectral envelope input representation includes at least one of at least one formant and at least one spectral trough in the form of at least one of a local peak and a local valley in the spectral envelope input representation, extracting from the at least one spectral envelope input representation a rapidly varying input component, where the rapidly varying input component is generated, at least in part, by removing from the at least one spectral envelope input representation a slowly varying input component in the form of a non-constant coarse shape of the at least one spectral envelope input representation and by keeping the fine details of the at least one spectral envelope input representation, where the details contain at least one of a peak or a valley, creating a rapidly varying final component, where the rapidly varying final component is derived from the rapidly varying input component by manipulating at least one of at least one peak and at least one valley, combining the rapidly varying final component with one of the slowly varying input component and the spectral envelope input representation to form a spectral envelope final representation, and providing a spectral speech description output vector to be used for synthesis of a speech utterance, where at least a part of the spectral speech description output vector is derived from the spectral envelope final representation.

2. Method as claimed in claim 1, where extracting a rapidly varying input component includes generating the slowly varying input component, at least in part, through smoothing of the spectral envelope input representation, where the smoothing attenuates the magnitude of at least one of the formant and the spectral trough and preserves a non-constant coarse shape of the spectral envelope input representation and deriving the rapidly varying input component by subtracting the slowly varying input component from the spectral envelope input representation.

3. Method as claimed in claim 2, where the step of generating the slowly varying input component includes low-pass (LP) filtering the spectral envelope input representation.

4. Method as claimed in claim 2, where the step of generating the slowly varying input component includes deriving the average of a first interpolation function $E_{max}(n)$ interpolating the maxima of the spectral envelope input representation and a second interpolation function $E_{min}(n)$ interpolating the minima of the spectral envelope input representation.

5. Method as claimed in claim 4, where maxima and minima are found by determining extrema of the spectral envelope input representation and by classifying them as minima or maxima and where for interpolating the interpolation functions shape-preserving piecewise cubic Hermite interpolating polynomials are used as interpolation kernels and where both interpolation functions are almost identical in the neighborhood of at least one of the Nyquist frequency and the zero frequency and therefore the rapidly varying input component is small preferably zero at least one of Nyquist frequency and zero frequency.

6. Method as claimed in claim 1, where the step of extracting from the at least one spectral envelope input representation a rapidly varying input component includes generating the rapidly varying input component at least in part by filtering the spectral envelope input representation with a high pass (HP) filter.

7. Method as claimed in claim 1, where the step of creating a rapidly varying final component includes modifying the rapidly varying input component with a transformation that attenuates the excursion of at least one of a first local minimum and a first local maximum of the rapidly varying input component and preserves the excursion of at least one of a second local maximum and a second local minimum of the rapidly varying component.

8. Method as claimed in claim 7, where the transformation performs at least one of sharpening the peaks and deepening the valleys in the spectral envelope input representation, preferably by multiplying the rapidly varying input component with a positive function that varies as a function of the frequency.

9. An article, comprising a non-transitory computer-readable medium having stored instructions that enable a machine to perform the steps of any of the claims 1 to 8.

* * * * *